US008165888B2

(12) United States Patent
Takahashi et al.

(10) Patent No.: US 8,165,888 B2
(45) Date of Patent: Apr. 24, 2012

(54) REPRODUCING APPARATUS

(75) Inventors: Kota Takahashi, Chofu (JP); Yasuo Masaki, Daito (JP)

(73) Assignees: The University of Electro-Communications, Chofu-shi (JP); Funai Electric Co., Ltd., Daito-shi (JP)

( * ) Notice: Subject to any disclaimer, the term of this patent is extended or adjusted under 35 U.S.C. 154(b) by 1076 days.

(21) Appl. No.: 12/048,297

(22) Filed: Mar. 14, 2008

(65) Prior Publication Data

US 2008/0235010 A1 Sep. 25, 2008

(30) Foreign Application Priority Data

Mar. 16, 2007 (JP) ..... 2007-068900

(51) Int. Cl.
*G10L 21/00* (2006.01)
*G10L 19/00* (2006.01)
*G10L 19/14* (2006.01)

(52) U.S. Cl. ..... 704/278; 704/211; 704/503

(58) Field of Classification Search ..... 704/278, 704/503

See application file for complete search history.

(56) References Cited

U.S. PATENT DOCUMENTS

| | | | | |
|---|---|---|---|---|
| 4,864,620 | A * | 9/1989 | Bialick | 704/207 |
| 5,611,018 | A * | 3/1997 | Tanaka et al. | 704/215 |
| 6,115,687 | A * | 9/2000 | Tanaka et al. | 704/269 |
| 7,912,710 | B2 * | 3/2011 | Sasaki et al. | 704/210 |

FOREIGN PATENT DOCUMENTS

| | | | |
|---|---|---|---|
| JP | 6-259093 | A | 9/1994 |
| JP | 09046647 | A * | 2/1997 |
| JP | 2955247 | B2 | 7/1999 |
| JP | 2003-241800 | A | 8/2003 |
| JP | 2003223199 | A * | 8/2003 |
| JP | 2005352047 | A * | 12/2005 |
| JP | 2006-127647 | A | 5/2006 |
| WO | WO 98/21710 | A1 | 6/1998 |

OTHER PUBLICATIONS

Werner Verhelst et al., "An Overlap-Add Technique Based on Waveform Similarity (WSOLA) for High Quality Time-Scale Modification of Speech", IEEE, vol. 2, 1993, pp. 554-557, Belgium.

Japanese Office Action dated Mar. 10, 2009 with English translation (five (5) pages).

* cited by examiner

*Primary Examiner* — Samuel G Neway
(74) *Attorney, Agent, or Firm* — Crowell & Moring LLP

(57) ABSTRACT

Disclosed is a reproducing apparatus comprising: a reproduction section to reproduce reproduction data comprising sound data and/or image data; a selection section to calculate evaluation values between a link source set for the reproduction data and each of a plurality of link destinations corresponding to the link source by a predetermined arithmetic expression based on link information of the plurality of link destinations, and to select a link destination having a highest evaluation among the evaluation values out of the plurality of link destinations; and a reproduction control section to move a reproduction point of the reproduction data reproduced by the reproduction section to a position corresponding to the link destination by linking the link source with the link destination when the reproduction point reaches a given point with respect to a position corresponding to the link source, and to instruct the reproduction section to reproduce the reproduction data.

15 Claims, 19 Drawing Sheets

LINK INFORMATION OF LINK SOURCE EXISTING IN FRAME HAVING FRAME NUMBER F = 20

| | | | | | | | | | | | | | | | | | | | | | | | |
|---|---|---|---|---|---|---|---|---|---|---|---|---|---|---|---|---|---|---|---|---|---|---|---|
| NUMBER OF LINKS | kmax[20] | 6 | | | | | | | | | | | | | | | | | | | | | |
| | | K=0 | | K=1 | | K=2 | | K=3 | | K=4 | | K=5 | |
| CATEGORY | ctgry[20][0] | 0 | ctgry[20][1] | 1 | ctgry[20][2] | 1 | ctgry[20][3] | 1 | ctgry[20][4] | 5 | ctgry[20][5] | 5 |
| SAMPLE NUMBER OF LINK DESTINATION | link[20][0] | 30380 | link[20][1] | 32456 | link[20][2] | 31218 | link[20][3] | 28716 | link[20][4] | 36626 | link[20][5] | 9232 |
| DISCREPANCY DEGREE | err[20][0] | 0.00 | err[20][1] | 5.26 | err[20][2] | 2.37 | err[20][3] | 3.58 | err[20][4] | 1.82 | err[20][5] | 4.65 |
| LOSS | loss[20][0] | 0.00 | loss[20][1] | 2.77 | loss[20][2] | 1.38 | loss[20][3] | 1.86 | loss[20][4] | 9.98 | loss[20][5] | 56.83 |

FIG. 4

| KIND OF LINK | CATEGORY ctgry[ F ][K] |
|---|---|
| EQUIVALENCE LINK | 0 |
| SIMPLE LINK | 1 |
| IN-SILENCE LINK | 2 |
| INTER-SILENCE LINK | 3 |
| PERIODIC SOUND LINK | 4 |
| SUBJECTIVE LINK | 5 |

FIG. 5A
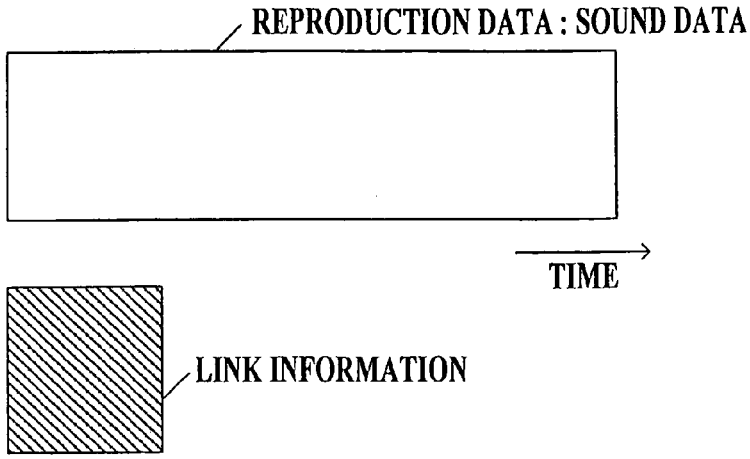
FIG. 5B
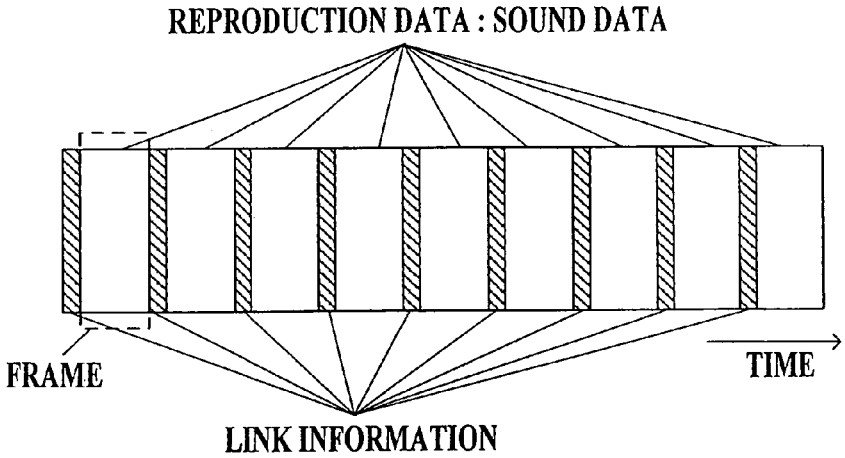
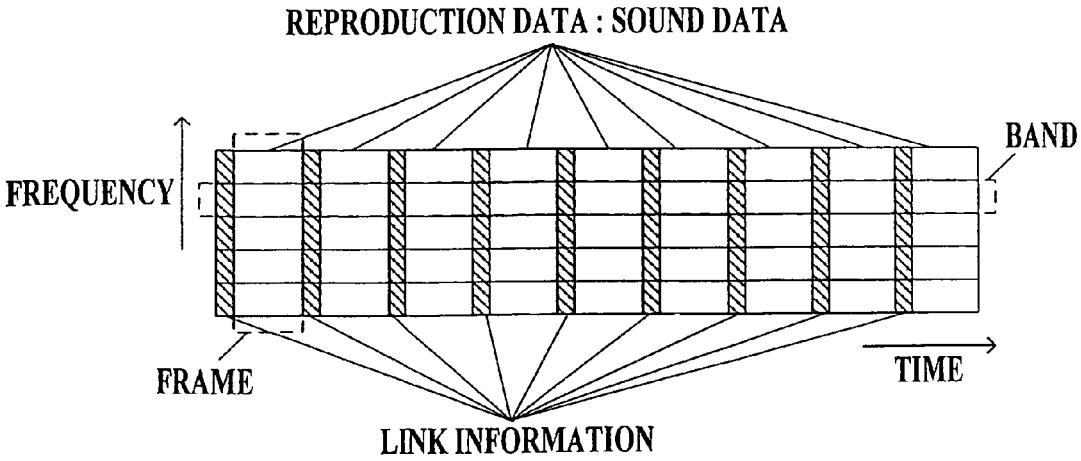
FIG. 5C

FIG.8A

| CLASSIFICATION | RETRIEVAL AREA (LINK LENGTH) | AVERAGE REPRODUCTION SPEED TO BE REALIZED |
|---|---|---|
| 1 | -6859 TO -6370 | -6 TO -12 |
| 2 | -5389 TO -5145 | -4.5 TO -6 |
| 3 | -3919 TO -3593 | -3 TO -4.5 |
| 4 | -6369 TO -5880 | -2.25 TO -3 |
| 5 | -3429 TO -2123 | -0.75 TO -2.25 |
| 6 | -1959 TO -490 | 0 |
| 7 | -489 TO 980 | 0.75 TO 2.25 |
| 8 | 2451 TO 2940 | 2.25 TO 3 |
| 9 | 1961 TO 2205 | 3 TO 4.5 |
| 10 | 3431 TO 3675 | 4.5 TO 6 |
| 11 | 4899 TO 5390 | 6 TO 12 |

FIG.8B

| CLASSIFICATION | RETRIEVAL AREA (LINK LENGTH) | AVERAGE REPRODUCTION SPEED TO BE REALIZED |
|---|---|---|
| 1 | -6859 TO -6370 | -6 TO -12 |
| 2 | -5389 TO -5145 | -4.5 TO -6 |
| 3 | -3919 TO -3593 | -3 TO -4.5 |
| 4 | -6369 TO -5880 | -2.25 TO -3 |
| 5 | -3429 TO -2123 | -0.75 TO -2.25 |
| 6 | -1959 TO -490 | 0 |
| 7a | -489 TO -327 | 0.75 TO 0.9 |
| 7b | 164 TO 490 | 1.125 TO 1.5 |
| 7c | 491 TO 980 | 1.5 TO 2.25 |
| 8 | 2451 TO 2940 | 2.25 TO 3 |
| 9 | 1961 TO 2205 | 3 TO 4.5 |
| 10 | 3431 TO 3675 | 4.5 TO 6 |
| 11 | 4899 TO 5390 | 6 TO 12 |
| 12 | 88200 TO 88935 | 90 TO 180 |

REPRODUCING APPARATUS

BACKGROUND OF THE INVENTION

1. Field of the Invention

The present invention relates to a reproducing apparatus.

2. Description of Related Art

Conventionally, when the enlargement and the reduction of a time axis are simply performed in order to change a speech speed by related art, the related art has a problem of the occurrence of changes of the pitch of the sound (the height of the voice) to make the sound hard to listen to and the like.

A speech speed converting technique of correcting the speech speed to be easy for a user to listen to by changing the speech speed without changing the pitch of the speech was proposed accordingly.

To put it concretely, for example, the reproducing apparatus was proposed that checks whether the waveform style of sound data is diagonally right up or diagonally right down and the like, and that unites the sound data having the same waveform style mutually to perform the processing of changing the speech speed without changing the pitch of the sound data (see, for example, Japanese Patent Application Laid-Open Publication No. 06-259093).

Moreover, the reproducing apparatus was proposed that divides sound data into a first half block and a second half block to perform the attenuation processing of the sound data in the first half block so that the attenuation rate thereof may gradually become larger, and to perform the attenuation processing of the sound data in the second half block so that the attenuation rate thereof may gradually become smaller. The apparatus further makes the first half block and the second half block, both subjected to the attenuation processing, overlap with each other to perform the processing of changing the speech speed without changing the pitch of the speech (see, for example, Japanese Patent Application Laid-Open Publication No. 2006-127647).

Moreover, the reproducing apparatus was proposed that makes the part of sound data multiplied by a window function changing diagonally right up and the part of the sound data multiplied by a window function changing diagonally right down overlap with each other to perform the processing of changing the speech speed of the sound data without changing the pitch thereof (see, for example, Japanese Patent No. 2955247B and ICASSP-93, Vol. 2, pp. 554-557, 1993).

However, the inventions disclosed in the Japanese Patent Application Laid-Open Publications, the Japanese Patent, and the ICASSP execute the processing of changing the speech speed without changing the pitch of the speech at the time of the reproduction of sound data, and consequently have a problem of increasing the calculation load of the reproducing apparatus at the time of the reproduction. Moreover, because the inventions do not perform the union or the overlap of the parts of sound data selected under close examination, the inventions also have the problem in which the reproduced sound is not always easy for a user to listen to.

SUMMARY OF THE INVENTION

It is an object of the present invention to provide a reproducing apparatus capable of performing variable speed reproduction of reproduction data in a state easy for a user to look at and listen to, and also capable of suppressing the calculation load at the time of reproduction.

According to a first aspect of the present invention, there is provided a reproducing apparatus comprising:

a reproduction section to reproduce reproduction data comprising sound data and/or image data;

a selection section to calculate evaluation values between a link source which is previously set for the reproduction data and each of a plurality of link destinations corresponding to the link source by a predetermined arithmetic expression based on link information pertaining to the plurality of link destinations, and to select a link destination having a highest evaluation among the evaluation values out of the plurality of link destinations;

a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data;

a specification section to specify a reproduction speed of the reproduction data; and a storage section to store the number of times of selecting each of the link destinations by the selection section, wherein the link information comprises:

link destination position information pertaining to the position of the link destination in the reproduction data;

discrepancy degree information pertaining to a discrepancy degree between a waveform of the link source and a waveform of the link destination; and loss information pertaining to a loss of signal energy caused by moving the reproduction point from the link source to the link destination, and wherein the selection section obtains error information pertaining to a temporal error between a specified reproduction point according to the reproduction speed specified by the specification section in the reproduction data and a link destination point based on the link destination position information included in the link information, calculates the evaluation values, each evaluation value being a sum of a product of the obtained error information and a weight for the error information set in the error information, a product of the discrepancy degree information included in the link information and a weight for the discrepancy degree information set in the discrepancy degree information, and a product of the loss information included in the link information and a weight for the loss information set in the loss information, and selects the link destination having a smallest evaluation value out of the link destinations each of which having the number of times which is stored in the storage section and which is less than a predetermined threshold value, among the plurality of link destinations.

According to a second aspect of the present invention, there is provided a reproducing apparatus comprising:

a reproduction section to reproduce reproduction data comprising sound data and/or image data;

a selection section to calculate evaluation values between a link source which is previously set for the reproduction data and each of a plurality of link destinations corresponding to the link source by a predetermined arithmetic expression based on link information pertaining to the plurality of link destinations, and to select a link destination having a highest evaluation among the evaluation values out of the plurality of link destinations; and a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data.

BRIEF DESCRIPTION OF THE DRAWINGS

FIG. 2A is a diagram for illustrating a link source and link destinations;

FIG. 4 is a diagram showing the relations between the kinds of links and categories ctgry[F][K];

FIGS. 5A, 5B, and 5C are diagrams for illustrating recording forms of reproduction data and link information onto a recording medium;

FIGS. 8A and 8B are diagrams showing the relations between the retrieval ranges of the link destinations and the average reproduction speeds to be realized when the link destinations are continued to be selected among the corresponding retrieval ranges;

DETAILED DESCRIPTION OF THE PREFERRED EMBODIMENTS

In the following, the preferred embodiments of the reproducing apparatus according to the present invention will be described in detail with reference to the attached drawings. Incidentally, the scope of the invention is not limited to the shown examples.

[First Embodiment]

A reproducing apparatus 1 of a first embodiment is first described.

Figure 12:
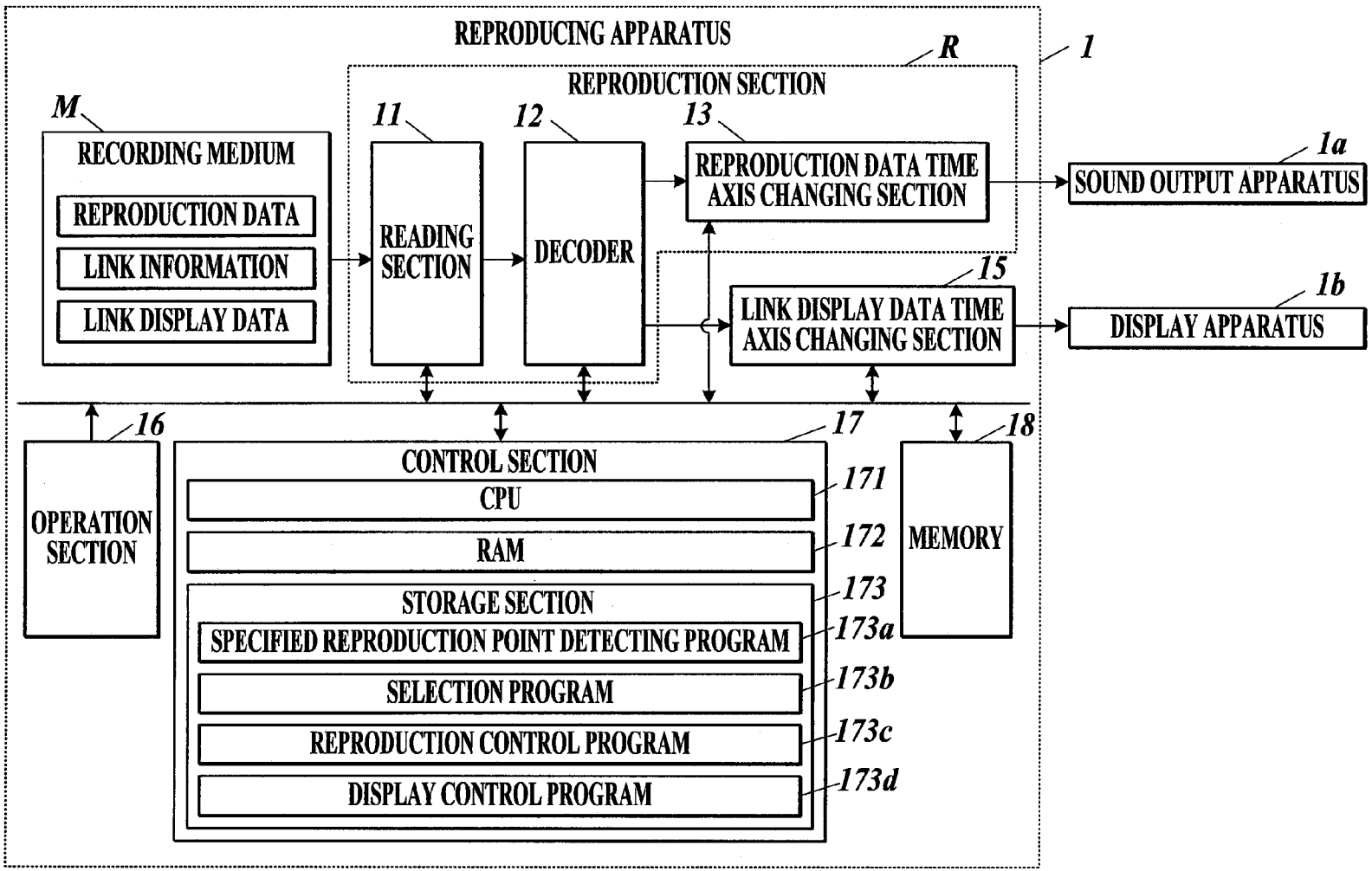
FIG. 12 is a block diagram showing a functional configuration of the reproducing apparatus of a first embodiment.

The reproducing apparatus 1 shown in FIG. 12 is an apparatus for reproducing reproduction data D of sound data, for example, recorded on a given recording medium M.

Figure 1:
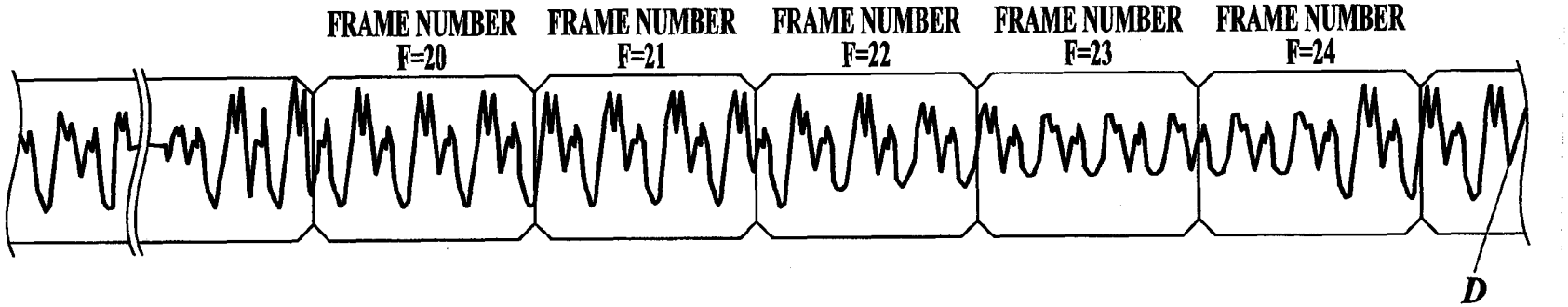
FIG. 1 is a diagram for illustrating reproduction data composed of sound data.
Figure 2B:
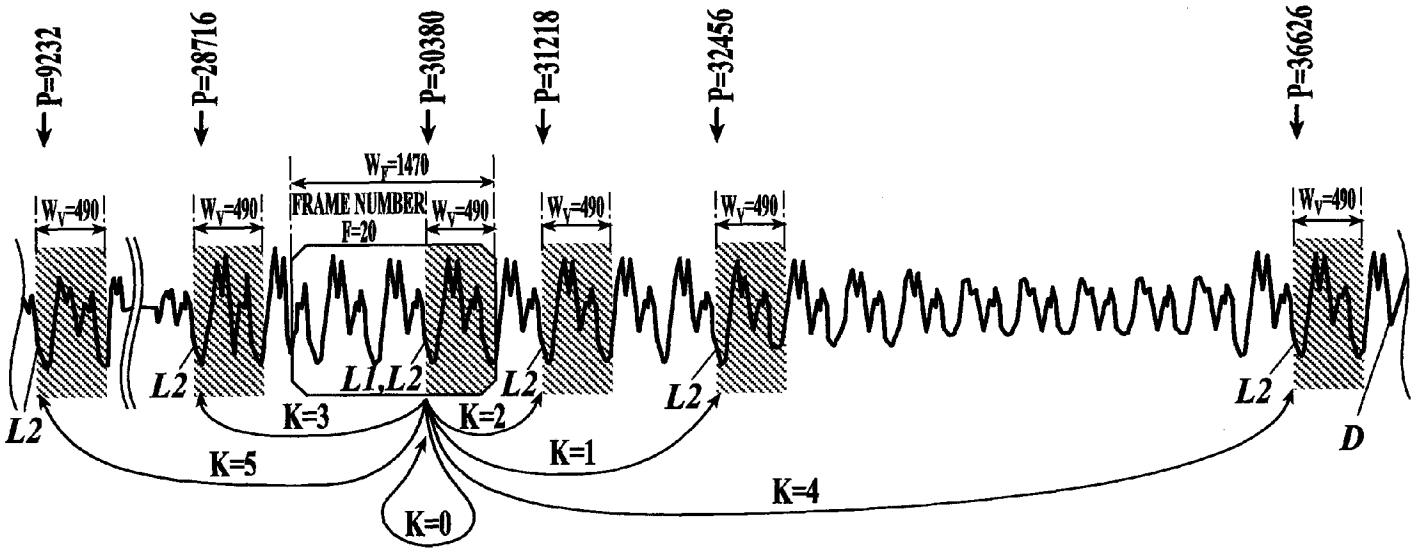
FIG. 2B is a diagram showing link information.
Figure 3:
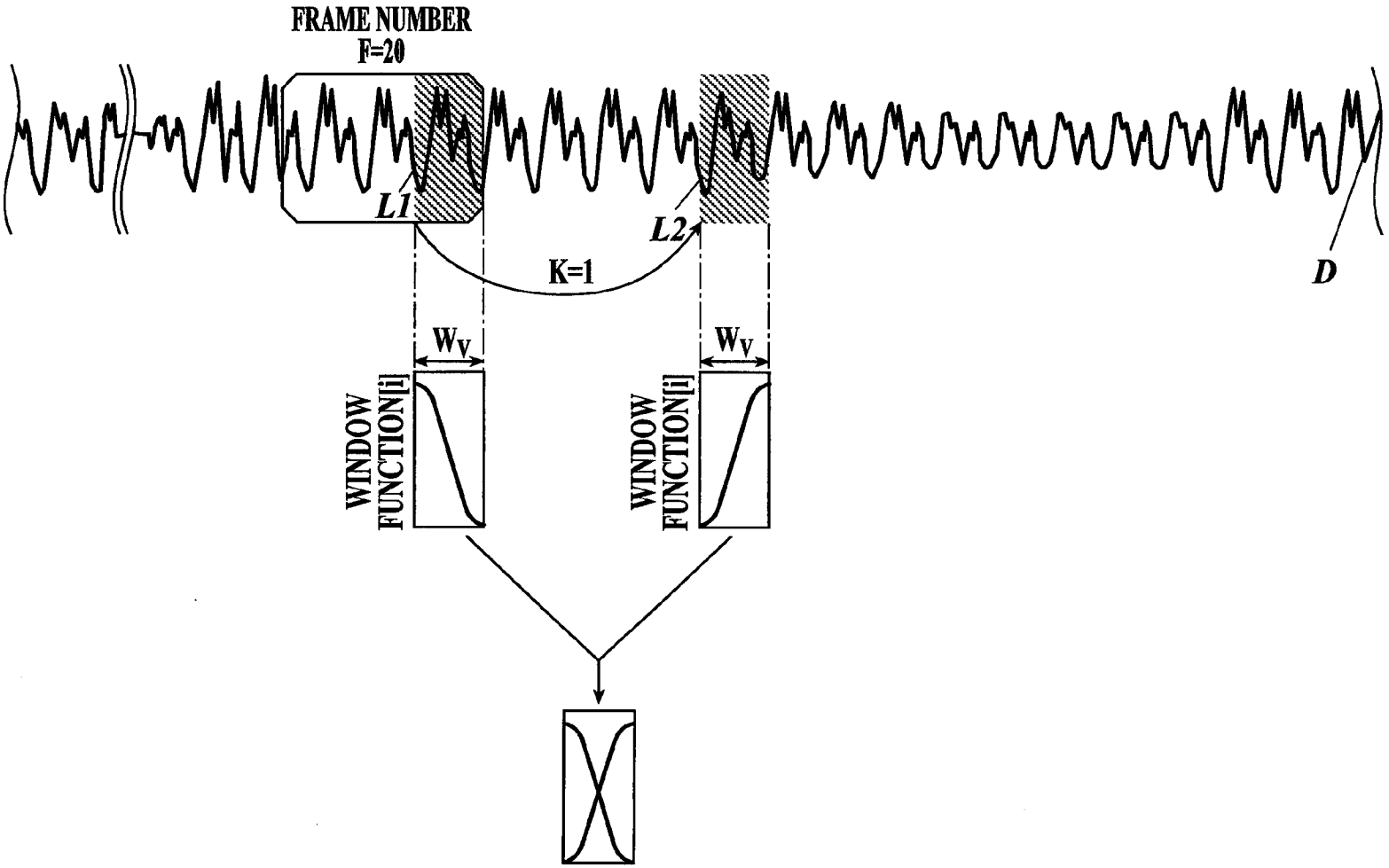
FIG. 3 is a diagram for illustrating overlaps of the overlap area of the link source and the overlap area of the link destination.
Figure 14:
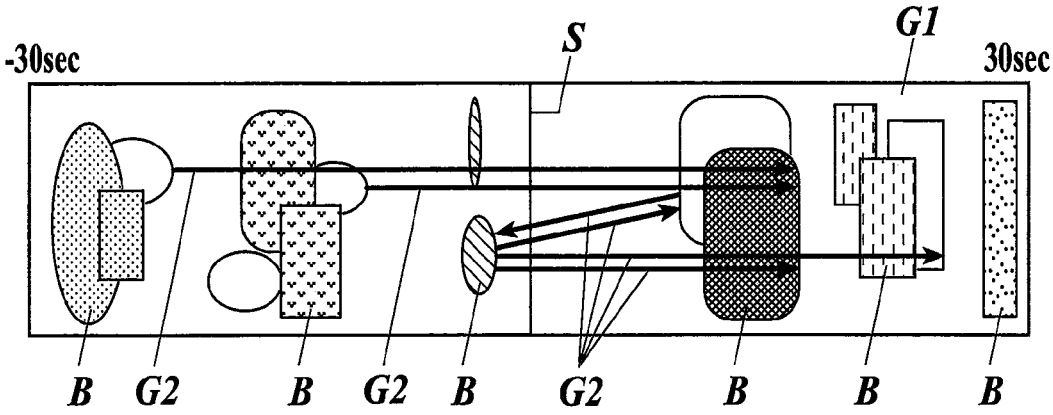
FIG. 14 is a diagram showing an example of a sound image arrangement diagram displayed on a display apparatus, in which diagram link images are synthesized.

The reproduction data D is, for example, recorded on the recording medium M together with previously set link information and link display data for the reproduction data D, as shown in FIGS. 1-3. The reproducing apparatus 1 changes the time axis of the reproduction data D based on, for example, the link information without changing the pitch of the reproduction data D to reproduce the reproduction data D. Moreover, as shown in FIG. 14, the reproducing apparatus 1 displays link images G2 according to the reproducing reproduction data D based on the link display data (for details, a sound image arrangement diagram G1, in which the link images G2 are synthesized).

The reproduction data D is previously recorded on, for example, the recording medium M.

Figure 6:
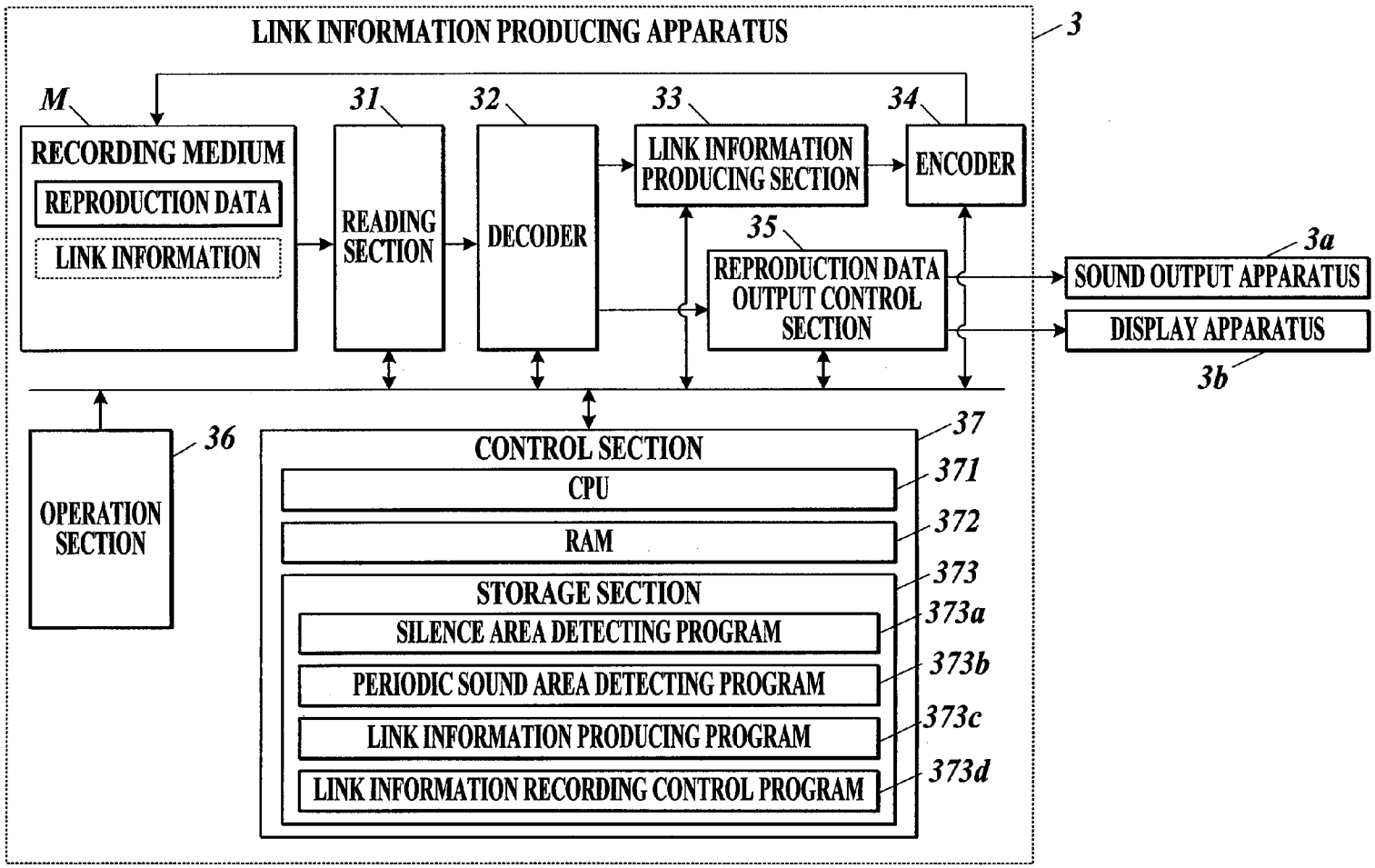
FIG. 6 is a block diagram showing a functional configuration of a link information producing apparatus for producing the link information.

The link information is produced based on the reproduction data D recorded on the recording medium M by, for example, a link information producing apparatus 3 shown in FIG. 6, to be recorded on the recording medium M.

Figure 10:
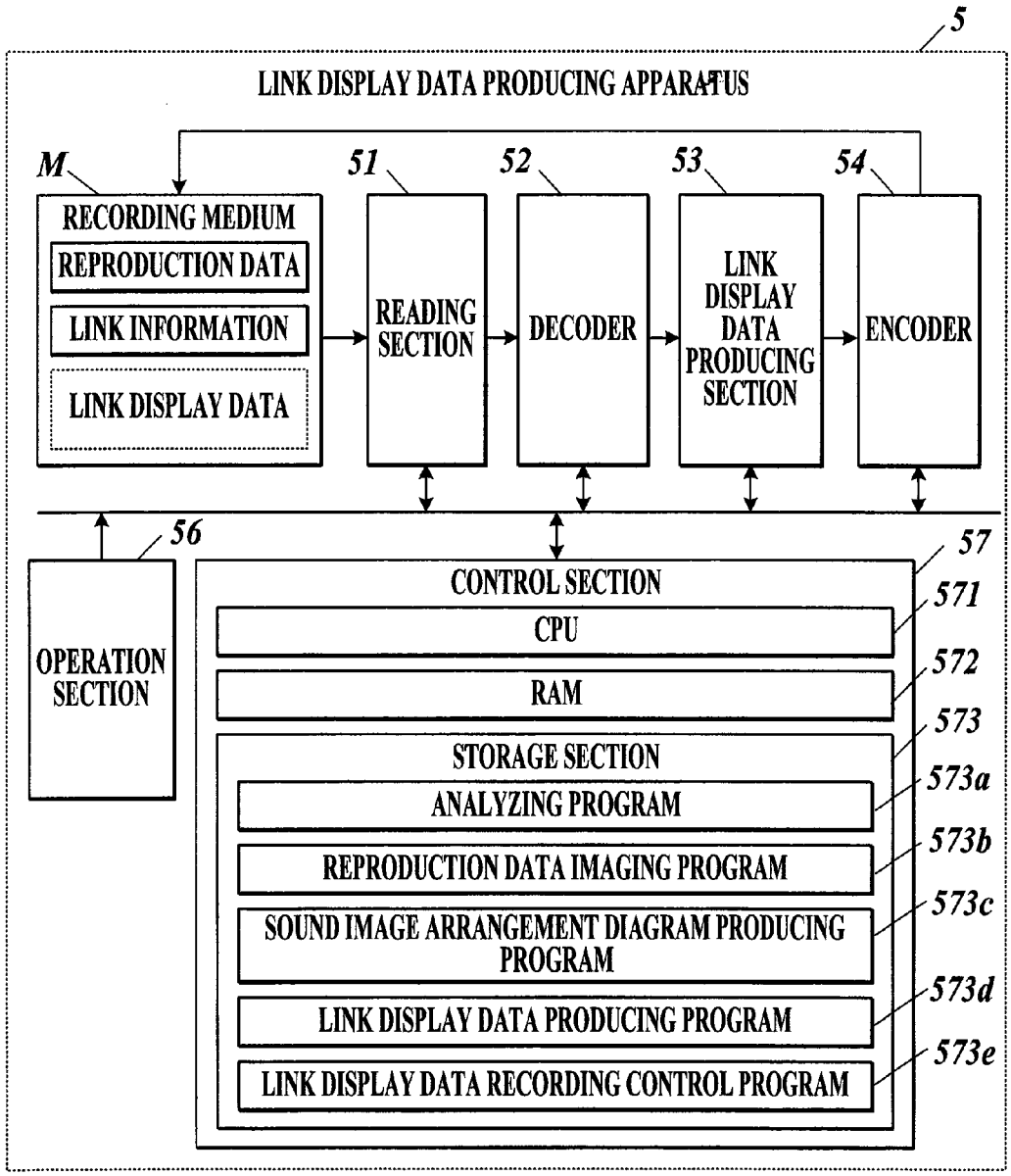
FIG. 10 is a block diagram showing the functional configuration of a link display data producing apparatus for producing link display data.

The link display data is produced based on the reproduction data D and the link information, both recorded on the recording medium M by, for example, a link display data producing apparatus 5 shown in FIG. 10, to be recorded on the recording medium M.

Incidentally, the recording medium M is an arbitrary medium as long as the medium on which data can be read and written, such as a compact disc (CD), a digital versatile disc (DVD), a hard disc drive (HDD), a semiconductor memory, a memory card and the like.

The reproduction data D is, for example, divided into fixed length frames with a certain sampling frequency as shown in FIG. 1, to be recorded on the recording medium M.

Incidentally, although the sampling frequency and the length of each frame are arbitrary ones, the sampling frequency is set as 44.1 kHz, and the length of each frame is set as 1/30 seconds, in the present embodiment. Consequently, the width $W_F$ of one frame is led to be 1470 samples in the present embodiment, as shown in FIG. 2A.

Here, frame numbers F are given to the respective frames in order from the first one (F=0, 1, . . . , Fmax (the total number of the frames)−1), and sample numbers P are given to the respective samples (respective signals) in the reproduction data in order from the first one (P=0, 1, . . . , Pmax (the total number of the samples)−1).

A link source L1 is respectively provided at, for example, a given position in each frame.

Incidentally, although the link source L1 can be provided at an arbitrary position in each frame, the accessed information can become utilized at a maximum when the link source L1 is provided in the vicinity of the end of the frame.

The reproducing apparatus 1 is here adapted to select a link destination L2 out of a plurality of link destinations L2 corresponding to the link source L1 here, for example, based on the link information, and to link the link source L1 to the selected link destination L2, at the time of the reproduction of the reproduction data D. The reproducing apparatus 1 is further adapted to make the waveform including the link source L1 as the starting point thereof and the waveform including the link destination L2 as the starting point thereof overlap with each other over a given width $W_V$ at the link part (patched part). In the present embodiment, for example, because the width $W_V$ of each of the overlap areas (hatched areas in FIG. 2A) is set to 490 samples as shown in FIG. 2A, the position of the link source L1 is determined to be set at a position temporally before 489 samples from the end of the frame also in consideration of the point that it is favorable to provide the link source L1 in the vicinity of the end of the frame.

Consequently, in the present embodiment, the sample number of the link source L1 in the frame of the frame number F is $P=((F+1)\times W_F-1)-(W_V-1)=(F+1)\times W_F-W_V$.

To put it concretely, for example, as shown in FIG. 2A, the sample number of the link source L1 in the frame of the frame number F=20 is P=30380 (=(20+1)×1470−490), and the overlap area of the link source L1 in the frame of the frame number F is 490 samples which are from P=30380 to P=30869.

It is necessary to design the reproducing apparatus 1 to be able to provide the link destination L2 at an arbitrary position in a frame because the similarity of the waveforms in the overlap area of the link source L1 and the overlap area in the link destination L2 is necessary to be high, for example, in order to keep the continuity of the waveform of the reproduction data D.

The overlap is now described.

When the sample number of the link source L1 is expressed by P1, the sample number of the link destination L2 is expressed by P2, and the reproduction data D (sound data) of the sample number P is expressed by data[P], an $i^{th}$ sample value out[i] of the output waveform of the overlap areas is calculated by a weighted average (the following formula (1)).

W[i] in the formula (1) here denotes a window function, and is defined by the following formula (2).

$$\text{out}[i] = W[i]\text{data}[P1+i] + (1-W[i])\text{data}[P2+i] \quad (1)$$

$$W[i] = \frac{1}{2}\cos\left(\frac{\pi(i+1)}{Wv+1}\right) + \frac{1}{2} \quad (i = 0, 1, \ldots, Wv-1) \quad (2)$$

To put it concretely, for example, the overlap area of the link source L1, which is multiplied by a window function W[i] changing diagonally right down, and the overlap area of the link destination L2, which is multiplied by a window function W[i] changing diagonally right up, overlap with each other as shown in FIG. 3.

The link information comprises, for example, the number of links Kmax[F], equivalence link information, simple link information, in-silence link information, inter-silence link information, periodic sound link information, and/or subjective link information and the like.

Each of the equivalence link information, the simple link information, the in-silence link information, the inter-silence link information, the periodic sound link information, and the subjective link information comprises, for example, a category ctgry[F][K], a link destination sample number link[F][K], a discrepancy degree err[F][K], a loss loss[F][K] and the like. Incidentally, each of the equivalence link information, the simple link information, the in-silence link information, the inter-silence link information, the periodic sound link information, and the subjective link information is identified by the category ctgry[F][K] thereof, as will be described below.

To put it concretely, for example, the link information pertaining to the link destinations L2 corresponding to the link source L1 existing in the frame of the frame number F=20 shown in FIG. 2A is, for example, the information shown in FIG. 2B.

The number of links Kmax[F] is the information showing the number of, for example, the link destinations L2 corresponding to the link source L1 existing in the frame of the frame number F, that is, the information expressing the number of links provided to the link source L1 in the frame of the frame number F.

For example, in the example of FIG. 2A, the number of the link destinations L2 corresponding to the link source L1 is six, that is, the number of the links provided to the link source L1 is six. Consequently, in FIG. 2B, the number of links Kmax[20]=6.

The category ctgry[F][K] is the information expressing the kind of, for example, the link of the link number K (K=0, 1, . . . , the number of links Kmax[F]−1) provided to the link source L1 existing in the frame of the frame number F, that is, the information expressing on what basis the link destinations L2 corresponding to the link source L1 existing in the frame of the frame number F are adopted.

The kinds of links include, for example, the equivalence link, the simple link, the in-silence link, the inter-silence link, the periodic sound link, the subjective link and the like. For example, the category ctgry[F][K]=0 expresses the equivalence link; the category ctgry[F][K]=1 expresses the simple link; the category ctgry[F][K]=2 expresses the in-silence link; the category ctgry[F][K]=3 expresses the inter-silence link; the category ctgry[F][K]=4 expresses the periodic sound link; and the category ctgry[F][K]=5 expresses the subjective link, as shown in FIG. 4.

The equivalence link is, for example, a link to the same position. To put it concretely, the equivalence link is, for example, the link adopting the same position as that of the link source L1 as the link destination L2.

By providing the prohibition of the movement of a reproduction point as the link in this manner, operations can be unified to one operation of searching the optimum link destination L2 at the time of reproducing the reproduction data D, and consequently the software of the reproducing apparatus 1 can be simplified.

The simple link is, for example, the link simply selected as the one having the waveform according with that of the link source L1 from a given retrieval range. To put it concretely, the simple link is, for example, the link adopting a minimum discrepancy degree point having the smallest discrepancy degree err[F][K] among arbitrary points existing in the given retrieval range from the position of the link source L1, as the link destination L2.

The in-silence link is, for example, a link for moving in a silence area. To put it concretely, for example, when the link source L1 is situated in a silence area in the reproduction data D, the in-silence link is the one adopting the starting point and the ending point of the silence area as link destinations L2.

The inter-silence link is, for example, a link for moving between different silence areas. To put it concretely, for example, when the link source L1 is situated in a silence area in the reproduction data D, the inter-silence link is the one adopting the ending point of a silence area different from the former silence area in the reproduction data D as a link destination L2.

The periodic sound link is, for example, a link in a periodic signal. To put it concretely, for example, when the link source L1 is situated at the starting point or the ending point of a periodic sound area in the reproduction data D, the periodic sound link is the one adopting the ending point and the starting point of the periodic sound area, respectively, as a link destination L2.

That is, for example, the periodic sound link includes the one having the starting point of a periodic sound area as the link source L1 and the ending point of the periodic sound area as a link destination L2, and the one having the ending point of a periodic sound area as the link source L1 and the starting point of the periodic sound area as a link destination L2.

The subjective link is, for example, a link manually provided by a user. To put it concretely, for example, the subjective link is the one adopting a specified link destination specified by a user as a link destination L2.

The user is a person producing link information by operating the link information producing apparatus 3 here. The user may be, for example, the person who has produced the production data D, or a person who appreciates the reproduction data D.

For example, because a category ctgry[20][0]=0 in the example shown in FIG. 2B, it can be found that the link of the link number K=0 is an equivalence link.

Moreover, because a category ctgry[20][1]=1, a category ctgry[20][2]=1, and a category ctgry[20][3]=1 in the example shown in FIG. 2B, it can be known that the links of the link numbers K=1, 2, and 3 are simple links.

Moreover, because a category ctgry[20][4]=5, and a category ctgry[20][5]=5 in the example shown in FIG. 2B, it can be known that the links of the link numbers K=4 and 5 are subjective links.

Here, for example, the equivalence link information is the information including the category ctgry[F][K]=0; the simple link information is the information including the category ctgry[F][K]=1; the in-silence link information is the information including the category ctgry[F][K]=2; the inter-silence link information is the information including the category ctgry[F][K]=3; the periodic sound link information is the information including the category ctgry[F][K]=4; and the subjective link information is the information including the category ctgry[F][K]=5.

Consequently, the link information of the link source L1 in the frame of the frame number F=20 shown in FIG. 2B results in the inclusion of a set of equivalence link information of the link number K=0; three sets of simple link information of the link numbers K=1, 2, and 3; and two sets of subjective link information of the link numbers K=4 and 5.

The link destination sample number link[F][K] is, for example, the link destination position information pertaining to the position of a link destination L2 in the reproduction data D, and is, for example, the sample number P of the link destination L2 linked to the link source L1 in the frame of the frame number F with the link of the link number K.

For example, because the link destination L2 of the link of the link number K=1 has the sample number P=32456 in the example shown in FIG. 2A, the link destination sample number link[F][K] is the link destination sample number link[20][1]=32456 in the example shown in FIG. 2B.

The discrepancy degree err[F][K] is, for example, the discrepancy degree information pertaining to the discrepancy degree between the waveforms in the overlap area of the link source L1 and the overlap area of the link destination L2. Thus, the discrepancy degree err[F][K] is a value expressing the discrepancy degree between the waveforms in the overlap area of the link source L1 in the frame of the frame number F and the overlap area of the link destination L2 linked to the link source L1 with the link of the link number K.

The discrepancy degree err[F][K] can be defined here by the following formula (3) by supposing the sample number of the link source L1 to be P1=(F+1)×$W_F$−$W_V$ and the sample number of the link destination L2 to be P2=link[F][K].

$$err[F][K] = \sum_{i=0}^{Wv-1} Ww[i](\text{data}[P1+i] - \text{data}[P2+i])^2 \tag{3}$$

The $W_W$[i] in the formula (3) denotes an evaluation weight based on the consideration of the influence of the weighting addition by the window function W[i], and it is preferable to set the evaluation weight $W_W$[i] to, for example, the one in accordance with the following formula (4).

By substituting the formula (4) for $W_W$[i] in the formula (3), the discrepancy degree err[F][K] becomes equal to the quantity obtained by weighting the energy of a correction amount from a link source signal and the energy of a correction amount from a link destination signal with the respective window functions W[i] to add the weighted pieces of energy, as shown in the following formula (5).

$$Ww[i] = 4W[i](1 - W[i]) \tag{4}$$

$$err[F][K] = \sum_{i=0}^{Wv-1} W[i](\text{out}[i] - \text{data}[P1+i])^2 + \sum_{i=0}^{Wv-1} (1 - W[i])(\text{out}[i] - \text{data}[P2+i])^2 \tag{5}$$

For example, because the link of the link number K=0 is an equivalence link in the example shown in FIG. 2A, the discrepancy degree err[F][K] results in the discrepancy degree err[20][0]=0, for example, in the example shown in FIG. 2B.

Moreover, for example, because the waveform in the overlap area of the link destination L2 of the link of the link number K=2 accords with the waveform in the overlap area of the link source L1 in much degree in comparison with the waveform in the overlap area of the destination L2 of the link of the link number K=1 in the example shown in FIG. 2A, the discrepancy degree err[20][2]=1.38 of the link number K=2 becomes a smaller value than the discrepancy degree err[20][1]=2.77 of the link number K=1, for example, in the example shown in FIG. 2B.

The loss loss[F][K] is, for example, the loss information pertaining to the loss of the signal energy produced by moving a reproduction point from the link source L1 to a link destination L2, and is, for example, a signal energy value of a waveform that is lost by moving from the link source L1 existing in the frame of the frame number F to a link destination L2 linked to the link source L1 with the link of the link number K.

When the reproduction speed of the reproduction data D is higher than the normal speed here (in the case of high speed reproduction), a link destination L2 existing in a temporally future direction compared to the link source L1 is selected as a movement destination of the reproduction point.

When the reproduction speed of the reproduction data D is lower than the normal speed (in the case of slow speed reproduction), a link destination L2 existing in a temporally past direction compared to the link source L1 is selected as the movement destination of the reproduction point. The way of the definition of the loss loss[F][K] in the case where the link destination L2 exists in the temporally future direction compared to the link source L1 differs from that in the case where the link destination L2 exists in the temporally past direction.

To put it concretely, for example, in the case where the link destination L2 exists in the temporally future direction of the link source L1, that is, in the case where the sample number P1 of the link source L1 is smaller than the sample number P2 of the link destination L2, the loss loss[F][K] is defined by the following formula (6) as the signal energy to be lost by omitting the signals between the link source L1 and the link destination L2. For example, in the case where the link destination L2 exists in the temporally past direction compared to the link source L1, that is, in the case where the sample number P1 of the link source L1 is larger than the sample number P2 of the link destination L2, the loss loss[F][K] is defined by the following formula (7) as the signal energy to be lost by repeating the signals between the link source L1 and the link destination L2.

$$\text{loss}[F][K] = \sum_{i=0}^{Wv-1} (1 - W[i])\text{data}[P1 + i]^2 + \sum_{i=P1+Wv}^{P2-1} \text{data}[i]^2 + \sum_{i=0}^{Wv-1} W[i]\text{data}[P2 + i]^2 \tag{6}$$

$$\text{loss}[F][K] = \sum_{i=0}^{Wv-1} W[i]\text{data}[P1 + i]^2 + \sum_{i=P2+Wv}^{P1-1} \text{data}[i]^2 + \sum_{i=0}^{Wv-1} (1 - W[i])\text{data}[P2 + i]^2 \tag{7}$$

By the formulae (6) and (7), the loss of the signal energy can be determined from the physical quantity of the signal.

Furthermore, the loss loss[F][K] can be determined by a user. That is, for example, when there is a significant problem in the existence of the sounds to be missed in the listening thereto by moving the reproduction point from the link source L1 to the link destination L2, the user increases the loss loss[F][K] to change it to be a larger value. Reversely, when the user judges that a link is the one to omit unnecessary parts as a result of subjectively judging the importance of words, phrases and the like, the user can decrease the loss loss[F][K] to change it to be a smaller value. Furthermore, when the user judges that it is necessary to provide a link to omit unnecessary parts as a result of subjectively judging the importance of words, phrases and the like, the user can consider the relative relations with the losses loss[F][K] of the other links to set the loss loss[F][K] of the link to omit the unnecessary parts. The links the loss loss[F][K] of which is determined by the user in such a way becomes the subjective link.

Incidentally, when the user determines the loss loss[F][K], the user is required to pay attention to the relative relation with the objective losses defined in conformity with the formulae (6) and (7).

The recording forms of the reproduction data D (sound data (waveform information)) and the link information to the recording medium M are arbitrary ones.

To put it concretely, for example, the reproduction data D may be recorded on the recording medium M separately from the link information as shown in FIG. 5A. In this case, because only the link information can be transferred to a memory 18 of the reproducing apparatus 1 just before the reproduction of the reproduction data D, the usability in this case is good.

Moreover, for example, when the reproduction data D is divided by the frame as shown in FIG. 5B, the link information corresponding to one frame may be set to be inserted before the one frame to be recorded on the recording medium M.

Moreover, for example, when the reproduction data D is divided by the frame and is also divided by a band frequency (a band) as shown in FIG. 5C, the link information corresponding to one frame and one band may be set to be inserted before the one frame and the one band to be recorded on the recording medium M.

Incidentally, in the present embodiment, for example, the reproduction data D is set to be recorded on the recording medium M separately from the link information as shown in FIG. 5A.

<Link Information Producing Apparatus>

The link information producing apparatus 3 comprises, for example, a reading section 31, a decoder 32, a link information producing section 33, an encoder 34, a reproduction data output control section 35, an operation section 36, a control section 37, and the like, as shown in FIG. 6.

Moreover, the link information producing apparatus 3 is connected to a sound output apparatus 3*a* and a display apparatus 3*b* through, for example, the reproduction data output control section 35.

The reading section 31 reads the reproduction data D recorded on the recording medium M inserted into the link information producing apparatus 3 in accordance with, for example, a control signal input from the control section 37, and outputs the read reproduction data D to the decoder 32.

The decoder 32 performs given processing, such as decoding and the like, to the reproduction data D input from the reading section 31 in accordance with, for example, the control signal input from the control section 37, and outputs the processed reproduction data D to the link information producing section 33 and the reproduction data output control section 35.

The link information producing section 33 is used, for example, when the control section 37 produces silence area information, periodic sound area information, and link information based on the reproduction data D input from the decoder 32.

The encoder 34 processes given processing, such as encoding and the like, to the link information produced by the link information producing section 33 in accordance with, for example, the control signal input from the control section 37, and outputs the processed link information to the recording medium M inserted into the link information producing apparatus 3.

The reproduction data output control section 35 is used, for example, when the control section 37 outputs the reproduction data D input from the decoder 32 to the sound output apparatus 3*a*, and when the control section 37 produces the envelope data of a sound waveform from the reproduction data D input from the decoder 32 to output the produced envelope data to the display apparatus 3*b*.

The sound output apparatus 3*a* is, for example, speaker equipment and the like, and outputs the sound based on, for example, the reproduction data D (sound data) input from the reproduction data output control section 35.

The display apparatus 3*b* is, for example, liquid crystal display equipment and the like, and displays, for example, the envelope of the sound waveform based on the reproduction data D (sound data) based on the envelope data input from the reproduction data output control section 35.

The operation section 36 comprises, for example, operation buttons (not shown) provided on the outer surface of the link information producing apparatus 3, a remote controller (not shown) for the link information producing apparatus 3, a remote control receiving section (not shown) capable of communicating with the remote controller and the like. The operation section 36 is, for example, operated by a user to output various signals pursuant to the operations to the control section 37.

Moreover, the operation section 36 may be provided with other operation apparatuses, such as a pointing device, such as a mouse and the like, and a jog dial, and the like as the occasion demands.

The control section 37 comprises, for example, a central processing unit (CPU) 371, a random access memory (RAM) 372, a storage section 373 and the like, as shown in FIG. 6.

The CPU 371 performs various control operations in accordance with, for example, various processing programs for the link information producing apparatus 3, which programs are stored in the storage section 373.

The RAM 372 comprises, for example, a program storing area for expanding processing programs to be executed by the CPU 371, and a data storing area for storing input data, the processing results to be produced at the time of the execution of the processing programs, and the like.

The storage section 373 stores, for example, a system program executable in the link information producing apparatus 3, various processing programs executable on the system program, the data to be used at the time of the execution of the various processing programs, and the data of the processing results of arithmetic processing of the CPU 371 and the like. Incidentally, the programs are stored in the storage section 373 in the forms of program codes readable by a computer.

To put it concretely, the storage section 373 stores, for example, a silence area detecting program 373*a*, a periodic sound area detecting program 373*b*, a link information producing program 373*c*, a link information recording control program 373*d* and the like.

The silence area detecting program 373*a* enables the CPU 371 to realize, for example, the function of detecting a silence area in the reproduction data D.

To put it concretely, the CPU 371, for example, makes the reading section 31 read the reproduction data D recorded on the recording medium M, and makes the reading section 31 output the read reproduction data D to the link information producing section 33 through the decoder 32.

Next, the CPU 371, for example, obtains a judgment threshold value for judging being silence from the signal energy distribution of the whole or part of the reproduction data D in the link information producing section 33. The processing of obtaining the judgment threshold value is necessary processing because the judgment threshold value concerning whether the reproduction data D including small background noises is silent or not differs from the one concerning whether the reproduction data D including large background noises is silent or not.

Next, the CPU 371, for example, detects the silence areas in the reproduction data D by judging the areas of the reproduction data D which areas have signal energy equal to or less than the obtained judgment threshold value to be the silence areas in the link information producing section 33.

Next, the CPU 371, for example, produces silence area information for each of the detected silence areas, and counts the total number Mmax of the detected silence areas in the link information producing section 33.

The silence area information of the $m^{th}$ (m=0, 1, . . . , Mmax−1) silence area here includes, for example, the sample number MA[m] of the starting point of the silence area, and the sample number MB[m] of the ending point of the silence area.

The periodic sound area detecting program 373*b* enables the CPU 371 to realize, for example, the function of detecting the periodic sound areas in the reproduction data D.

To put it concretely, the CPU 371, for example, makes the reading section 31 read the reproduction data D recorded on the recording medium M, and makes the reading section 31 output the read reproduction data D to the link information producing section 33 through the decoder 32.

Next, the CPU 371, for example, detects the periodic sound areas in the reproduction data D by judging the areas, each having a certain or wider width, in which areas the signal energy is changing at certain periods in the reproduction data D, as the periodic sound areas in the link information producing section 33.

Next, the CPU 371, for example, produces periodic sound area information for each of the detected periodic sound areas, and counts the total number Nmax of the detected periodic sound areas in the link information producing section 33.

The periodic sound area information of the $n^{th}$ (n=0, 1, . . . , Nmax−1) periodic sound area includes, for example, the sample number NA[n] of the starting point of the periodic sound area and the sample number NB[n] of the ending point of the periodic sound area.

The link information producing program 373*c* enables the CPU 371 to realize, for example, the function of producing link information based on the reproduction data D.

To put it concretely, the CPU 371 first sets the number of links Kmax[F]=0 by initializing the number of links Kmax[F] (F=0, 1, 2, . . . , Fmax−1).

Next, the CPU 371 executes, for example, the processing of producing equivalence link information (equivalence link information producing processing).

The CPU 371 first, for example, makes the reading section 31 read the reproduction data D recorded on the recording medium M, and makes the reading section 31 output the read reproduction data D to the link information producing section 33 through the decoder 32.

Next, the CPU 371, for example, produces the equivalence link information in which the category ctgry[F][0]=0, the link destination sample number link[F][0]=the sample number of the link source L1, the discrepancy degree err[F][0]=0, and the loss loss[F][0]=0 are set for all the frames (frame number F=0 to Fmax−1) in the link information producing section 33. The CPU 371 then increments the number of links Kmax[F] corresponding to the equivalence link at every production of the equivalence link information.

Next, the CPU 371 executes, for example, the processing of producing simple link information (simple link information producing processing).

The simple link information is, for example, the information of expressing the minimum discrepancy degree point having the smallest discrepancy degree err[F][K] among the arbitrary points existing in a given retrieval range from the position of the link source L1 as the link destination L2.

For example, even when the average reproduction speed is almost the same, the number of frames that must be accessed in one second (access rate) sometimes varies according to the number of samples from the link source L1 to a link destination L2 (link length) here. To put it concretely, for example, when the link length is short, the number of frames that must be accessed in one second is large. When the link length is long, the number of frames that must be accessed in one second is small. In the case of the same reproduction speed, a smaller access rate has better efficiency.

Figure 7A:
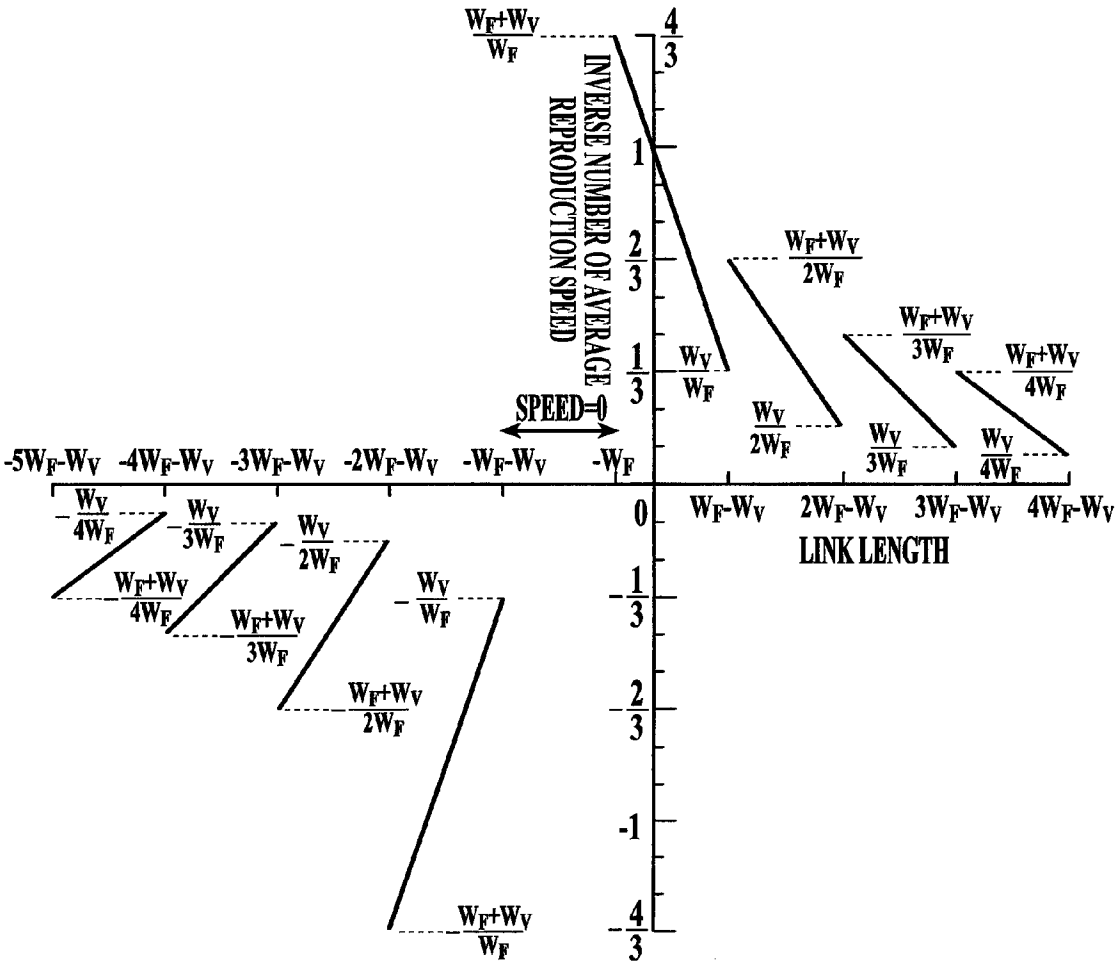
FIGS. 7A and 7B are diagrams showing the relations between link lengths and inverse numbers of average reproduction speeds at the time of continuing to select the link destinations that are the corresponding link lengths.
Figure 7B:
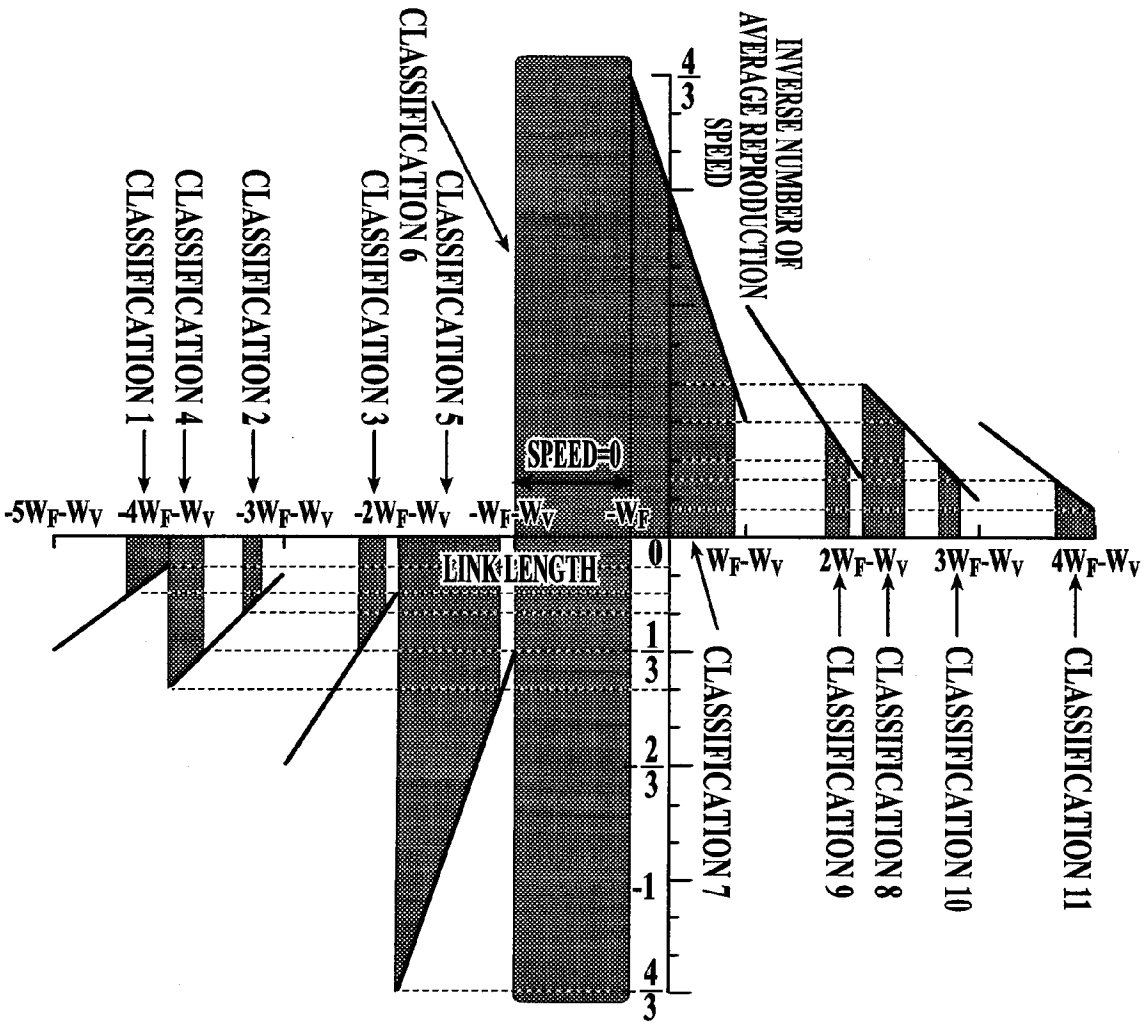

FIG. 7A shows the relations between the numbers of samples (link lengths) from the link source L1 to link destinations L2 and the inverse numbers of average reproduction speeds when the selections of the link destinations L2 which are corresponding link lengths, are continued. FIG. 7B shows the areas in which the access rates are lower (hatched parts in FIG. 7B) pertaining to the link lengths expressing the same average reproduction speeds in FIG. 7A.

FIG. 8A shows a table made based on the hatched parts of FIG. 7B. When a link destination L2 of the simple link is searched for, it is preferable to search for the minimum discrepancy degree point at which the discrepancy degree err[F][K] becomes the minimum value in each of the retrieval ranges in FIG. 8A as the link destination L2. At that time, because the average reproduction speed of the "classification 7" in FIG. 8A is close to the normal speed, the "classification 7" is important and is frequently used. When the retrieval range of the "classification 7" is divided into two or three areas accordingly, the number of simple links increases to increase the candidates of the link destination L2. Consequently, the division would bring about a preferable result at the time of reproduction. FIG. 8B shows a table in which the retrieval range of the "classification 7" in FIG. 8A is divided into three retrieval ranges accordingly.

Moreover, the table of FIG. 8B includes an added new "classification 12" which corresponds to a long length link in which the time difference between the link source L1 and the link destination L2 is about two seconds. Such a long length link is very effective to the reproduction data D in which the temporal error between the specified reproduction point specified by a user and the link source L1 is large in high speed reproduction to make it impossible to recover the difference only by means of a short distance simple link, and in which silence areas do not completely exist to make it impossible to perform a long distance movement.

The CPU 371 first makes the reading section 31 read, for example, the reproduction data D recorded on the recording medium M, and makes the reading section 31 output the read reproduction data D to the link information producing section 33 through the decoder 32.

The CPU 371 next searches, for example, the retrieval range of each classification shown in FIG. 8B in the link information producing section 33 for the minimum discrepancy degree point at which the discrepancy degree err[F][K] becomes minimum, for each of the link sources L1 in all the frames (frame number F=0 to Fmax−1). The CPU 371 then produces the simple link information expressing that the category ctgry[F][Kmax[F]]=1, the link destination sample number link[F][Kmax[F]]=the sample number of the minimum discrepancy degree point, the discrepancy degree err[F][Kmax[F]]=the value obtained from the formula (3), and the loss loss[F][Kmax[F]]=the value obtained from the formula (6) or the formula (7), for each of the searched minimum discrepancy degree points. The CPU 371 then increments the number of links Kmax[F] corresponding to the simple link at every production of the simple link information.

The retrieval ranges (see, for example, FIG. 8B) is stored in the link information producing apparatus 3 in advance.

The CPU 371 next executes, for example, the processing of producing in-silence link information (in-silence link information producing processing).

The in-silence link information is, for example, the information for expressing the starting point and the ending point of a silence area as link destinations L2 when a link source L1 exists in the silence area in the reproduction data D.

The CPU 371 first makes the reading section 31 read, for example, the reproduction data D recorded on the recording medium M, and makes the reading section 31 output the read reproduction data D to the link information producing section 33 through the decoder 32.

The CPU 371 next produces, for example, the in-silence link information expressing that the category ctgry[F][Kmax[F]]=2, the link destination sample number link[F][Kmax[F]]=the sample number MB[m] of the ending point of the $m^{th}$ silence area, the discrepancy degree err[F][Kmax[F]]=the value obtained from the formula (3), the loss loss[F][Kmax[F]]=the value obtained from the formula (6) or the formula (7), for all the frames existing in the $m^{th}$ silence area detected by the CPU 371 that has executed the silence area detecting program 373*a* in the order of m=0, 1, . . . , (Mmax−1). The CPU 371 also produces the in-silence link information expressing that the category ctgry[F][Kmax[F]]=2, the link destination sample number link[F][Kmax[F]]=the sample number MA[m] of the starting point of the $m^{th}$ silence area, the discrepancy degree err[F][Kmax[F]]=the value obtained from the formula (3), the loss loss[F][Kmax[F]]=the value obtained from the formula (6) or the formula (7), for all the frames. The CPU 371 then increments the number of links Kmax[F] corresponding to the in-silence link information at every production of the in-silence link information.

Because the in-silence link is the link in a silence area here, the loss loss[F][K] obtained from the formula (6) or the formula (7) is "0."

The CPU 371 next executes, for example, the processing of producing inter-silence link information (inter-silence link information producing processing).

The inter-silence link information is, for example, the information expressing that the ending point of a silence area different from the silence area in which a link source L1 is situated in reproduction data D is set as a link destination L2.

The CPU 371 first makes the reading section 31 read, for example, the reproduction data D recorded on the recording medium M, and makes the reading section 31 output the read reproduction data D to the link information producing section 33 through the decoder 32.

The CPU 371 next produces the inter-silence link information expressing that the category ctgry[F][Kmax[F]]=3, the link destination sample number link[F][Kmax[F]]=the sample number MB[m] of the ending point of a silence area other than the $m^{th}$ silence area, the discrepancy degree err[F][Kmax[F]]=the value obtained from the formula (3), the loss loss[F][Kmax[F]]=the value obtained from the formula (6) or the formula (7), to all the frames existing in the $m^{th}$ silence area detected by the CPU 371 that has executed the silence area detecting program 373*a* in the order of m=0, 1, . . . , (Mmax−1). The CPU 371 then increments the number of links Kmax[F] corresponding to the inter-silence link information at every production of the inter-silence link information.

The CPU 371 next executes, for example, the processing of producing periodic sound link information (periodic sound link information producing processing).

The periodic sound link information is, for example, the information expressing that the ending point and the starting point of a periodic sound area in the reproduction data D as link destinations L2 in the case where the link source L1 is situated in the starting point or the ending point of the periodic sound area.

The CPU 371 first makes the reading section 31 read, for example, the reproduction data D recorded on the recording medium M, and makes the reading section 31 output the read reproduction data D to the link information producing section 33 through the decoder 32.

The CPU 371 next produces the periodic sound link information expressing that the category ctgry[F][Kmax[F]]=4, the link destination sample number link[F][Kmax[F]]=the sample number NB[m] of the ending point of the $n^{th}$ periodic sound area, the discrepancy degree err[F][Kmax[F]]=the value obtained from the formula (3), the loss loss[F][Kmax[F]]=the value obtained from the formula (6) or the formula (7), to the frame closest to the starting point of the $n^{th}$ periodic sound area in the $n^{th}$ periodic sound area detected by the CPU 371 that has executed the periodic sound area detecting program 373*b* in the order of n=0, 1, (Nmax−1). The CPU 371 next produces the periodic sound link information expressing that the category ctgry[F][Kmax[F]]=4, the link destination sample number link[F][Kmax[F]]=the sample number NA[m] of the starting point of the $n^{th}$ periodic sound area, the discrepancy degree err[F][Kmax[F]]=the value obtained from the formula (3), the loss loss[F][Kmax[F]]=the value obtained from the formula (6) or the formula (7), to the frame closest to the ending point of the $n^{th}$ periodic sound area in the $n^{th}$ periodic sound area detected by the CPU 371 that has executed the periodic sound area detecting program 373*b*. The CPU 371 then increments the number of links Kmax[F] corresponding to the periodic sound link information at every production of the periodic sound link information.

Furthermore, the CPU 371 executes, for example, the processing of producing subjective link information (subjective link information producing processing) in accordance with a user's operation of the operation section 36.

The subjective link information is, for example, the information expressing that a specified link destination specified by a user's operation of the operation section 36 is set as the link destination L2.

Incidentally, the subjective link information may be the information the loss loss[F][K] of which has been changed among the previously produced simple link information, in-silence link information, inter-silence link information, and periodic sound link information by a user's operation of the operation section 36.

The user can here listen to the sound output from the sound output apparatus 3*a*, looking at the envelope of the sound waveform displayed on the display apparatus 3*b* by instructing the production of the subjective link information, and can control the reproduction point of the reproduction data D by operating the jog dial and the like of the operation section 36. The user can then specify, for example, a specified link source or a specified link destination by operating the operation section 36 so as to provide links with unnecessary parts omitted according to the degrees of importance of words, conversations, and speakers, and can input the loss loss[F][K] of the link.

The CPU 371 first makes the reading section 31 read, for example, the reproduction data D recorded on the recording medium M, and makes the reading section 31 output the read reproduction data D to the link information producing section 33 and the and reproduction data output control section 35 through the decoder 32.

The CPU 371 next outputs, for example, the reproduction data D to the sound output apparatus 3*a* in the reproduction data output control section 35, and produces the envelope data of the sound waveform based on the reproduction data D to output the produced envelope data to the display apparatus 3*b*. The sound based on the reproduction data D (sound data) is hereby output from the sound output apparatus 3*a*, and the envelop of the sound waveform based on the reproduction data D (sound data) is led to be displayed from the display apparatus 3*b*. Incidentally, for example, the envelopes of the sound waveforms corresponding to the sounds spanning over the time from the past to the future including the sound at the present time that is being output from the sound output apparatus 3*a* are displayed on the display apparatus 3*b*.

When a specified link source and a specified link destination are, for example, specified by a user, the CPU 371 next determines to provide a subjective link from the link source L1 existing in the frame closest to the specified link source, and changes the position of the specified link destination to a position that is situated within a given scope from the position of the specified link destination, at which position the discrepancy degree err[F][K] of the waveform to that of the link source L1 determined to be provided with the subjective link becomes small. The CPU 371 then produces the subjective link information expressing that the category ctgry[F][Kmax[F]]=5, the link destination sample number link[F][Kmax[F]]=the sampler number of the specified link destination the position of which has been changed, the discrepancy degree err[F][Kmax[F]]=the value obtained from the formula (3), and the loss loss[F][Kmax[F]]=the value input by the user, to the frame closest to the specified link source. The CPU 371 then increments the number of links Kmax[F] corresponding to the subjective link information every production of the subjective link information.

Moreover, for example, when the simple link information, the in-silence link information, the inter-silence link information, and the periodic sound link information that pertain the link linking the specified link source specified by the user with the specified link destination exist in the information that has been already produced, then the CPU 371 changes the category ctgry[F][Kmax[F]] constituting the information to "5," and changes the loss loss[F][K] to the "value input by the user." The CPU 371 thereby changes the information to the subjective link information.

The link information recording control program 373*d* enables the CPU 371 to realize, for example, the function of recording the link information produced in the link information producing section 33 by the CPU 371 which has executed the link information producing program 373*c*, onto the recording medium M through the encoder 34.

(Link Information Producing Processing)

Figure 9:
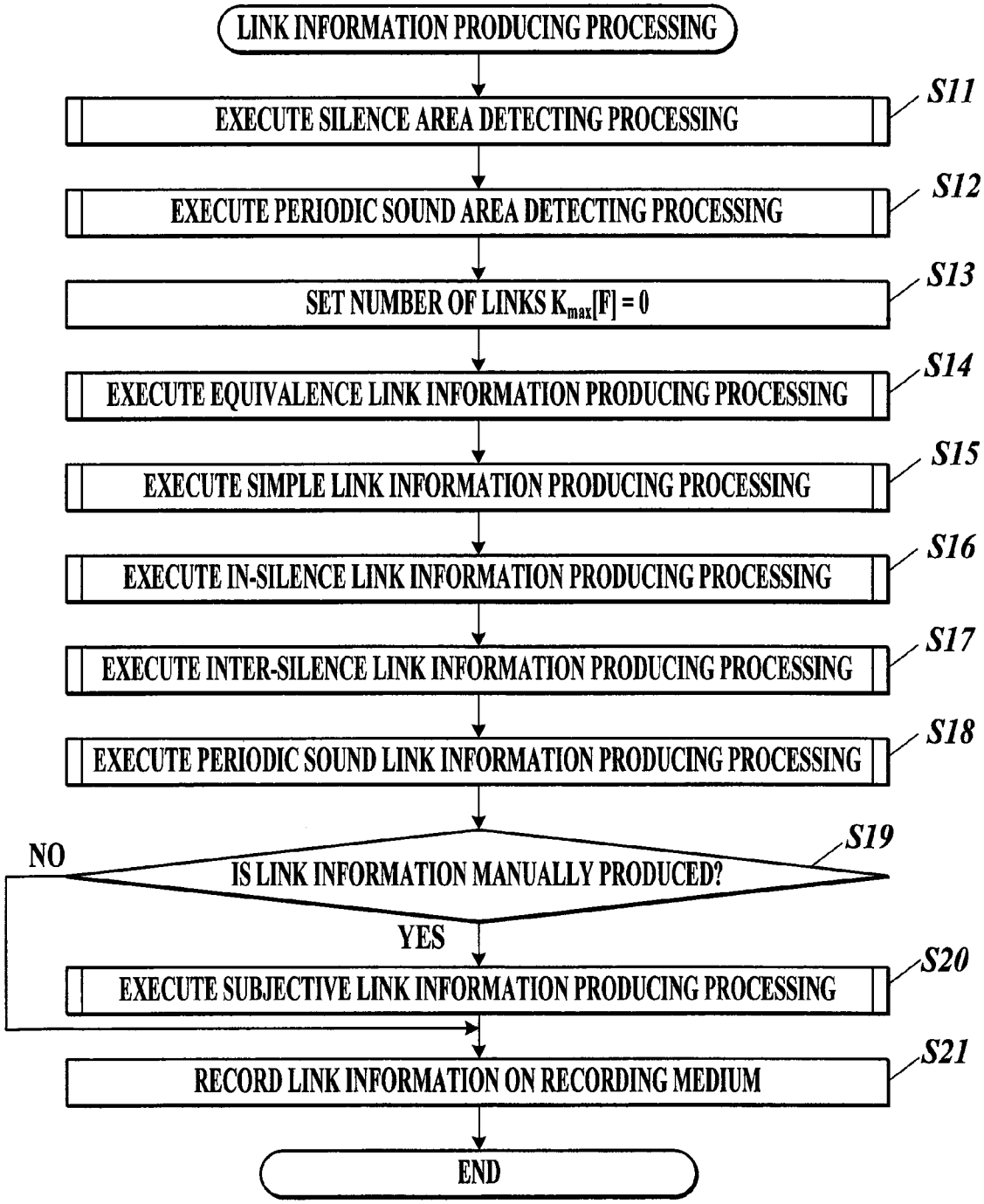
FIG. 9 is a flow chart for illustrating a processing pertaining to the production of the link information by the link information producing apparatus.

The processing pertaining to the production of link information by the link information producing apparatus 3 is described with reference to the flow chart of FIG. 9.

For example, when the link information producing apparatus 3 is instructed by a user's operation of the operation section 36 to automatically produce link information, the CPU 371 executes the silence area detecting program 373*a* to execute the silence area detecting processing (Step S11).

To put it concretely, the CPU 371, for example, detects a silence area in the reproduction data D in the link information producing section 33, and produces silence area information including the sample number MA[m] of the starting point of the silence area, the sample number MB[m] of the ending point of the silence area, and the like.

The CPU 371 next executes the periodic sound area detecting program 373*b*, and executes the periodic sound area detecting processing (Step S12).

To put it concretely, the CPU 371, for example, detects a periodic sound area in the reproduction data D in the link information producing section 33, and produces periodic sound area information including the sample number NA[n] of the starting point of the periodic sound area, the sample number NB[n] of the ending point of the periodic sound area, and the like.

The CPU 371 next executes the link information producing program 373*c*, and sets the number of links Kmax[F]=0 (Step S13).

The CPU 371 next executes the equivalence link information producing processing (Step S14).

To put it concretely, the CPU 371, for example, produces equivalence link information in the link information producing section 33, and increments the number of links Kmax[F] corresponding to the equivalence link.

The CPU 371 next executes the simple link information producing processing (Step S15).

To put it concretely, the CPU 371, for example, produces simple link information in the link information producing section 33, and increments the number of links Kmax[F] corresponding to the simple link.

The CPU 371 next executes the in-silence link information producing processing (Step S16).

To put it concretely, the CPU 371, for example, produces in-silence link information based on the silence area information obtained at Step S11 in the link information producing section 33, and increments the number of links Kmax[F] corresponding to the in-silence link.

The CPU 371 next executes the inter-silence link information producing processing (Step S17).

To put it concretely, the CPU 371, for example, produces inter-silence link information based on the silence area information obtained at Step S11 in the link information producing section 33, and increments the number of links Kmax[F] corresponding to the inter-silence link.

The CPU 371 next executes the periodic sound link information producing processing (Step S18).

To put it concretely, the CPU 371, for example, produces periodic sound link information based on the periodic sound area information obtained at Step S12 in the link information producing section 33, and increments the number of links Kmax[F] corresponding to the periodic sound link.

The CPU 371 next judges whether the production of link information is manually input or not by a user's operation of the operation section 36 (Step S19).

When the CPU 371 judges that the manual input of the production of the link information by the user's operation of the operation section 36 has not been performed at Step S19 (Step S19; No), the CPU 371 moves to the processing of Step S21.

On the other hand, when the CPU 317 judges that the manual input of the production of the link information by the user's operation of the operation section 36 has been performed at Step S19 (Step S19; Yes), the CPU 371 executes the subjective link information producing processing (Step S20).

To put it concretely, the CPU 371, for example, makes the sound output apparatus 3*a* output the sound based on the reproduction data D (sound data) in the reproduction data output control section 35, and makes the display apparatus 3*b* display the envelope of the sound waveform based on the reproduction data D (sound data). The CPU 371 then produces the subjective link information in the link information producing section 33, and increments the number of links Kmax[F] corresponding to the subjective link when it is necessary.

The CPU 371 next executes the link information recording control program 373*d*, and makes the recording medium M record the link information produced in the link information producing section 33 through the encoder 34 (Step S21) to end the present processing.

Incidentally, after the processing at Step S21, the information pertaining to the unnecessary links may be removed out of the produced link information by a user's operation of the operation section 36.

<Link Display Data Producing Apparatus>

The link display data producing apparatus 5 comprises, for example, a reading section 51, a decoder 52, a link display data producing section 53, an encoder 54, an operation section 56, a control section 57 and the like, as shown in FIG. 10.

The reading section 51 reads the reproduction data D and link information, both recorded on the recording medium M inserted into the link display data producing apparatus 5, in accordance with, for example, a control signal input from the control section 57, and output the read reproduction data D and the link information to the decoder 52.

The decoder 52 performs given processing, such as decoding, to the reproduction data D and the link information, both input from the reading section 51, in accordance with, for example, a control signal input from the control section 57, and outputs the processed reproduction data D and the link information to the link display data producing section 53.

The link display data producing section 53 is used, for example, when the control section 57 produces link display data based on the reproduction data D and the link information both input from the decoder 52.

The encoder 54 processes given processing, such as encoding, to the link display data produced by the link display data producing section 53 in accordance with, for example, a control signal input from the control section 57, and outputs the processed link display data to the recording medium M inserted into the link display data producing apparatus 5.

The operation section 56 comprises, for example, operation buttons (not shown) provided on the outer surface of the link display data producing apparatus 5, a remote controller (not shown) for the link display data producing apparatus 5, and a remote control receiving section (not shown) capable of communicating with the remote controller. The operation section 56 is, for example, operated by a user to output various signals pursuant to the operations to the control section 57.

The control section 57 comprises, for example, a CPU 571, a RAM 572, a storage section 573 and the like, as shown in FIG. 10.

The CPU 571 performs various control operations in accordance with, for example, various processing programs for the link display data producing apparatus 5, stored in the storage section 573.

The RAM 572 includes, for example, a program storing area for expanding processing programs to be executed by the CPU 571, and a data storing area for storing input data, processing results to be produced at the time of the execution of the processing programs, and the like.

The storage section 573 stores, for example, a system program executable in the link display data producing apparatus 5, various processing programs executable on the system program, the data to be used at the time of the execution of the various processing programs, and the data of the processing results subjected to arithmetic processing by the CPU 571. Incidentally, the programs are stored in the storage section 573 in the forms of program codes readable by a computer.

To put it concretely, the storage section 573 stores, for example, a analyzing program 573*a*, a reproduction data imaging program 573*b*, a sound image arrangement diagram producing program 573*c*, a link display data producing program 573*d*, a link display data recording control program 573*e* and the like.

The analyzing program 573*a* enables the CPU 571 to realize, for example, the function of analyzing the reproduction data D (sound data) in accordance with given analysis conditions.

To put it concretely, the CPU 571, for example, makes the reading section 51 read the reproduction data D recorded on the recording medium M, and makes the reading section 51 output the read reproduction data D to the link display data producing section 53 through the decoder 52.

Next, the CPU 571, for example, analyzes the reproduction data D in accordance with the given analysis conditions in the link display data producing section 53.

The analysis conditions are, for example, a time-frequency plane expression by fast Fourier transformation (FFT), cepstrum analysis, or Wigner analysis, and the estimation of a pole position by autoregressive (AR) model. Moreover, the analysis conditions may be experiential conditions according with human intuition even when the experiential conditions lack the supports such as theoretical optimality.

The reproduction data imaging program 573*b* enables the CPU 571 to realize, for example, the function of converting an analysis result by the CPU 571, which has executed the analyzing program 573*a*, into the image data correspondingly set to the analysis result in advance.

To put it concretely, the CPU 571, for example, converts an analysis result by the CPU 571 which has executed the analyzing program 573*a*, into red (R), green (G), and blue (B) values, and the number of pixels (image size) corresponding to the parameter values obtained by the analysis in the link display data producing section 53, and thereby makes the analysis result to be a pixel small piece as a pixel group including a color expressed by the R, G, and B values. Hence, the CPU 571 converts the analysis result into the image data of a sound image B.

The sound image arrangement diagram producing program 573*c* enables the CPU 571 to realize, for example, the function of producing the sound image arrangement diagram G1, in which the sound images B based on the image data imaged by the CPU 571 which has executed the reproduction data imaging program 573*b*, are arranged in association with a given time axis in the link display data producing section 53.

The link display data producing program 573*d* enables the CPU 571 to realize, for example, the function of producing link display data for displaying the temporal association of the link source L1 with each link destination L2 by synthesizing the link images G2, which express the links linking the link source L1 with the link destinations L2 corresponding to the link source L1, with the sound image arrangement diagram G1, associating the link images G2 with the time axis of the sound image arrangement diagram G1 produced by the CPU 571, which has executed the sound image arrangement diagram producing program 573*c*, based on the link information.

To put it concretely, the CPU 571 makes the reading section 51 read, for example, the link information recorded on the recording medium M, and makes the reading section 51 output the read link information to the link display data producing section 53 through the decoder 52.

The CPU 571 next produces, for example, link display data based on the link information in the link display data producing section 53.

It is supposed here that the CPU 571 synthesizes, for example, only the link images G2 showing the links, each having the link length (the number of samples from the link source L1 to the link destination L2) equal to or more than a given number of samples (for example, ten thousand samples or more), with the sound image arrangement diagram G1.

The link display data recording control program 573*e* enables the CPU 571 to realize, for example, the function of making the recording medium M record the link display data produced by the CPU 571, which has executed the link display data producing program 573*d*, in the link display data producing section 53 through the encoder 54.

(Link Display Data Producing Processing)

Figure 11:
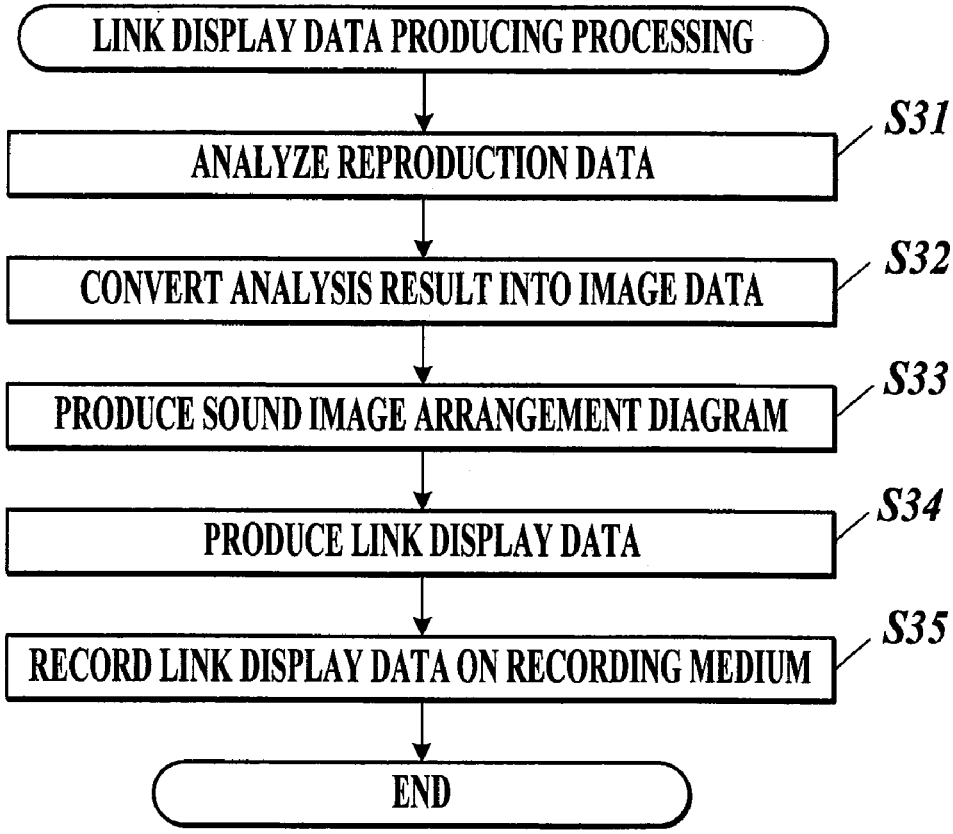
FIG. 11 is a flow chart for illustrating a processing pertaining to the production of link display data by the link display data producing apparatus.

The processing pertaining to the production of link display data by the link display data producing apparatus 5 is described with reference to the flow chart of FIG. 11.

For example, when the link display data producing apparatus 5 is instructed by a user's operation of the operation section 56 to produce link display data, the CPU 571 executes the analyzing program 573*a* to analyze the reproduction data D in accordance with given analysis conditions (Step S31).

The CPU 571 next executes the reproduction data imaging program 573*b*, and converts the analysis result obtained by the processing at Step S31 into the image data set according to analysis results in advance (Step S32).

The CPU 571 next executes, for example, the sound image arrangement diagram producing program 573*c*, and produces the sound image arrangement diagram G1, in which the sound images B, based on the image data imaged by the processing at Step S32, are arranged in association with the given time axis (Step S33).

The CPU 571 next executes the link display data producing program 573*d*, and produces the link display data for displaying the temporal association of the link source L1 with each of the link destinations L2 by synthesizing the ling images G2, showing the links linking the link source L1 with the link destinations L2 corresponding to the link source L1, with the sound image arrangement diagram G1 in association with the time axis of the sound image arrangement diagram G1 produced by the processing at Step S33 based on the link information (Step S34).

The CPU 571 next executes the link display data recording control program 573*e*, and makes the recording medium M record the link display data produced by the processing at Step S34 through the encoder 54 (Step S35). Then, the CPU 571 ends the present processing.

<Reproducing Apparatus>

The reproducing apparatus 1 comprises, for example, a reproduction section R, a link display data time axis changing section 15, an operation section 16, a control section 17, and the memory 18, as shown in FIG. 12.

Moreover, the reproducing apparatus 1 is connected to the sound output apparatus 1*a* through, for example, a reproduction data time axis changing section 13 of the reproduction section R, and is connected to the display apparatus 1*b* through the link display data time axis changing section 15.

The reproduction section R comprises, for example, a reading section 11, a decoder 12, and the reproduction data time axis changing section 13, as shown in FIG. 12. The reproduction section R, for example, reproduces reproduction data D composed of sound data as the reproduction section.

The reading section 11 reads, for example, the reproduction data D, link information, and link display data, each recorded on the recording medium M inserted into the reproducing apparatus 1, in accordance with a control signal input from the control section 17, and output the read reproduction data D, link information, and link display data to the decoder 12.

The decoder 12 performs given processing, such as decoding, to the reproduction data D and the link information, each input from the reading section 11, in accordance with, for example, a control signal input from the control section 17, and outputs the processed reproduction data D and the link information to the reproduction data time axis changing section 13. The decoder 12 further performs the given processing, such as the decoding, to the link display data input from the reading section 11, and outputs the processed link display data to the link display data time axis changing section 15.

The reproduction data time axis changing section 13 is used, for example, when the control section 17 changes the time axis of the reproduction data D without changing the pitch thereof based on the link information input from the decoder 12 to output the changed reproduction data D to the sound output apparatus 1*a*.

The sound output apparatus 1*a* is, for example, speaker equipment, and outputs the sound based on, for example, the reproduction data D (sound data) input from the reproduction data time axis changing section 13.

The link display data time axis changing section 15 is used, for example, when the control section 17 changes the time axis of the link display data input from the decoder 12 according to the change of the time axis of the reproduction data D in the reproduction data time axis changing section 13 to output the changed link display data to the display apparatus 1*b*.

The display apparatus 1*b* is, for example, liquid crystal display equipment, and displays, for example, a sound image arrangement diagram G1, in which link images G2 are synthesized, based on the link display data input from the link display data time axis changing section 15.

The operation section 16 comprises, for example, operation buttons (not shown) provided on the outer surface of the reproducing apparatus 1, a remote controller (not shown) for the reproducing apparatus 1, and a remote control receiving section (not shown) capable of communicating with the remote controller. The operation section 16 is, for example, operated by a user to output various signals pursuant to the operations to the control section 17.

To put it concretely, the operation section 16 is operated, for example, when the user specifies the reproduction speed of the reproduction data D as a specification section.

The memory 18 comprises, for example, a semiconductor memory, against which data can be read and written, and stores given data in accordance with a control signal input from the control section 17.

To put it concretely, the memory 18 stores, for example, the number of times of the selection of each link destination L2 selected by a CPU 171, which has executed a selection program 173*b*, as the storage section.

To put it more concretely, for example, when a link destination L2 is selected by the CPU 171, which has executed the selection program 173*b*, to a link source L1 situated in the frame of the frame number F, the control section 17 makes the memory 18 store a set {F, K} of the frame number F and the link number K of the link linking the link source L1 with the selected link destination L2.

The memory 18 is adapted to store, for example, a given number (for example, 100) of the newest sets {F, K} here.

Incidentally, for example, when the link destination L2 selected by the CPU 171, which has executed the selection program 173*b*, is the link destination L2 that is liked with the link source L1 by an equivalence link, the control section 17 is adapted not to store the set {F, K} in the memory 18.

When a reproduction point is moved by a link, especially in the case of slow speed reproduction, it is incidental to use the same link repeatedly, and a user sometimes feels the period of the repetition strongly to feel it discomfortable. In order to prevent the repetition, the sets {F, K} are set to be stored in the memory 18 accordingly. However, because any substantial movements of the reproduction points are performed in the equivalence links, any user does not feel any discomfort even when the equivalence links are repeatedly utilized, and the recording of the sets {F, K} into the memory 18 is not profitable in the case of the equivalence links. The present embodiment is adapted not to record the sets {F, K} in the memory 18 in the case of the equivalence links accordingly.

Moreover, the memory 18, for example, stores the link information recorded on the recording medium M just before the reproduction of the reproduction data D by the reproduction section R.

To put it more concretely, for example, when the control section 17 is instructed to reproduce the reproduction data D by a user's operation of the operation section 16, the control section 17 makes the reading section 11 read the link information recorded on the recording medium M, and makes the reading section 11 output the read link information to the memory 18 through the decoder 12. Then, the control section 17 makes the memory 18 store the link information.

The control section 37 comprises, for example, the CPU 171, a RAM 172, and a storage section 173, as shown in FIG. 12.

The CPU 171 performs various control operations in accordance with, for example, various processing programs for the reproducing apparatus 1, stored in the storage section 173.

The RAM 172 includes, for example, a program storing area for expanding processing programs to be executed by the CPU 171, and a data storing area for storing input data, processing results to be produced at the time of the execution of the processing programs, and the like.

The storage section 173 stores, for example, a system program executable in the reproducing apparatus 1, various processing programs executable on the system program, the data to be used at the time of the execution of the various processing programs, and the data of the processing results subjected to arithmetic processing by the CPU 171. Incidentally, the programs are stored in the storage section 173 in the forms of program codes readable by a computer.

To put it concretely, the storage section 173 stores, for example, a specified reproduction point detecting program 173*a*, the selection program 173*b*, a reproduction control program 173*c*, and a display control program 173*d*, as shown in FIG. 12.

The specified reproduction point detecting program 173*a* enables the CPU 171 to realize, for example, the function of detecting a specified reproduction point according to the reproduction speed specified by a user's operation of the operation section 16 in the reproduction data D.

To put it concretely, for example, when the reproduction point of the reproduction data D by the reproduction section R reaches a given point to the position of the link source L1, the CPU 171 detects the sample number of the next time reproduction point (specified reproduction point) according to the reproduction point at the present time specified by the user out of the reproduction data D based on the reproduction speed specified by the user from the state of the reproduction of the reproduction data D to the present time in the reproduction data time axis changing section 13.

The given point may be a position corresponding to the link source L1 here, or may be a position distant from the position corresponding to the link source L1 by a given number of samples. In the present embodiment, the given point is set to be the position corresponding to the link source L1.

That is, when the reproduction position of the reproduction data D by the reproduction section R reaches the position corresponding to the link source L1, the CPU 171 detects the sample number of the specified reproduction point.

Figure 13:
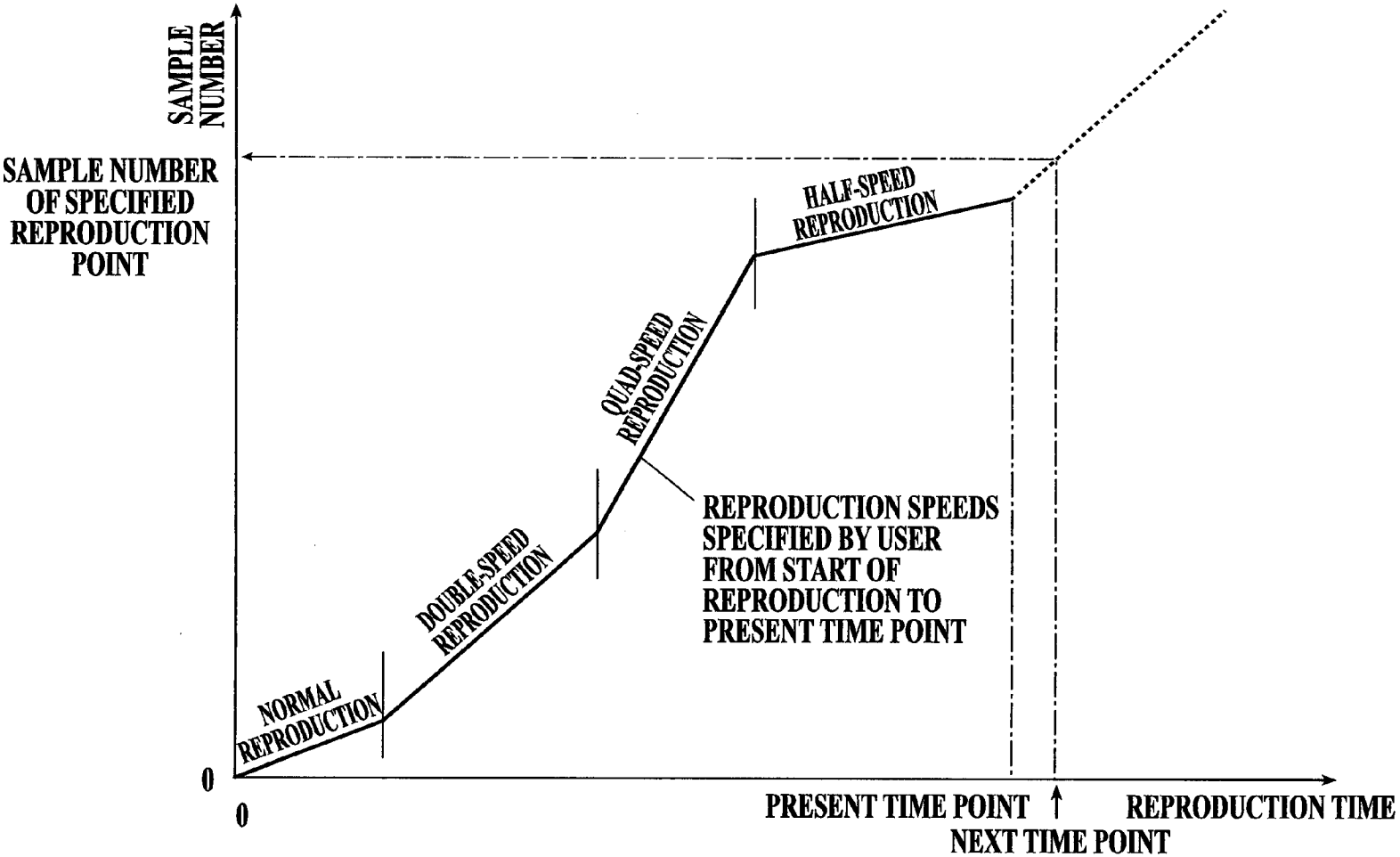
FIG. 13 is a diagram showing an example of the changes of a reproduction speed specified by a user from the start of reproduction of reproduction data to the present time point.

To put it more concretely, for example, as the graph shown in FIG. 13, when the reproduction time from the start of reproduction of the reproduction data D is taken on the abscissa axis of the graph and the sample number of a reproduction point according to the reproduction speed specified by a user is taken on the ordinate axis of the graph, the reproduction speeds specified by the user form the start of the reproduction of the reproduction data D to the present time is shown as, for example, the thick line shown in FIG. 13. Moreover, when the reproduction speed at the present time, which has been specified by the user is changed at the present time from, for example, "half speed" to "double speed," the reproduction speed is shown, for example, as the broken line of FIG. 13.

The CPU 171 then detects the sample number of the specified reproduction point according to the reproduction speed specified by the user at the present time (for example, the broken line of FIG. 13) out of the reproduction data D based on, for example, the reproduction speeds specified by the user from the start of the reproduction of the reproduction data D to the present time (for example, the thick line of FIG. 13).

It is a matter of course that the reproduction speed at the present time is not limited to the changing from, for example, the "half speed" to the "double speed" in FIG. 13, but may be constant to be at the "half speed" as it is, or may be changed to a speed other than the "double speed." For example, when the reproduction speed at the present time is constant to be as the "half speed" in FIG. 13 as it is, the CPU 171 is led to detect the sample number of the specified sample point according to the reproduction speed specified by the user at the present time (for example, the extended line of the thick line of FIG. 13) out of the reproduction data D based on the reproduction speed specified by the user from the start of the reproduction to the present time (for example, the thick line of FIG. 13).

The selection program 173*b* enables the CPU 171 to realize, for example, the function of calculating the evaluation values E between the link source L1 set to the reproduction data D in advance and each of a plurality of link destinations L2 corresponding to the link source L1 by a previously determined given arithmetic expression based on the link information pertaining to the plurality of link destinations L2, and of selecting the link destination L2 having the highest evaluation among evaluation values E out of plurality of link destinations L2.

To put it concretely, for example, when the specified reproduction point is detected by the CPU 171, which has executed the specified reproduction point detecting program 173*a*, the CPU 171 obtains the error information $E_T$ pertaining to the temporal error between the detected specified reproduction point and the link destination point based on the link destination position information (link destination sample number link[F][K]) included in the link information in the reproduction data time axis changing section 13.

Next, the CPU 171, for example, calculates the evaluation value E based on the discrepancy degree information $E_E$ (EE=discrepancy degree err[F][K]) included in the obtained error information $E_T$ and the loss information $E_L$ ($E_L$=loss loss[F][K]) included in the link information in the reproduction data time axis changing section 13.

The evaluation value E is, for example, calculated as the sum of the product of the error information $E_T$ and a weight $C_T$ for the error information, which is settable to the error information $E_T$, the product of the discrepancy degree information $E_E$ and a weight $C_E$ for the discrepancy degree information, which is settable to the discrepancy degree information $E_E$, and the product of the loss information $E_L$ and a weight $C_L$ for the loss information, which is settable to the loss information $E_L$, as shown by the following formula (8).

$$E=C_TE_T+C_EE_E+C_LE_L \tag{8}$$

The weight $C_T$ for the error information, the weight $C_E$ for the discrepancy degree information, and the weight $C_L$ for the loss information are settable as, for example, the following formula (9) here.

$$(C_T, C_E, C_L) = \begin{cases} (1.0,0.0,0.8) \\ (1.0,9.3,0.0) \end{cases} \tag{9}$$

The weights $C_T$, $C_E$, and $C_L$ noted in the upper row pertain to the link destinations situated in the future direction of the link source, and the weights $C_T$, $C_E$, and $C_L$ noted in the lower row pertain to the link destinations situated in the past direction of the link source.

That is, different weights $C_T$ for the error information are settable to the error information $E_T$ obtained from the link information pertaining to the link destinations L2 situated in the temporally future direction of the link source L1 (link destinations L2 in the positive direction links), and to the error information $E_T$ obtained from the link information pertaining to the link destinations L2 situated in the temporally past direction of the link source L1 (link destinations L2 in the reverse direction links).

Moreover, different weights $C_E$ for the discrepancy degree information are settable to the discrepancy degree information $E_E$ included in the link information pertaining to the link destinations L2 situated in the temporally future direction of the link source L1 (link destinations L2 in the positive direction links), and to the discrepancy degree information $E_E$ included in the link information pertaining to the link destinations L2 situated in the temporally past direction of the link source L1 (link destinations L2 in the reverse direction links).

Moreover, different weights $C_L$ for the loss information are settable to the loss information $E_L$ included in the link information pertaining to the link destinations L2 situated in the temporally future direction of the link source L1 (link destinations L2 in the positive direction links), and to the loss information $E_L$ included in the link information pertaining to the link destinations L2 situated in the temporally past direction of the link source L1 (link destinations L2 in the reverse direction links).

Incidentally, for example, the weight $C_L$ for the loss information formula is made to be larger than the weight $C_E$ for the discrepancy degree information as to the link destinations L2 to be selected at the time of high speed reproduction, that is, the link destinations L2 situated in the temporally future direction of the link source L1, and the weight $C_L$ for the loss information formula is made to be smaller than the weight $C_E$ for the discrepancy degree information as to the link destinations L2 to be selected at the time of slow speed reproduction, that is, the link destinations L2 situated in the temporally past direction of the link source L1 as shown in the formula (9). Thereby, the sounds that are easy for a user to listen to can be obtained.

The weight $C_T$ for the error information, the weight $C_E$ for the discrepancy degree information, and the weight $C_L$ for the loss information may be, for example, previously set in the reproducing apparatus 1, or may be adapted to be able to be set by a user's operation of the operation section 16. Furthermore, the weight $C_T$ for the error information, the weight $C_E$ for the discrepancy degree information, and the weight $C_L$ for the loss information may be, for example, previously set in the reproducing apparatus 1 and may be adapted to be able to be changed by a user's operation of the operation section 16.

Incidentally, the weight $C_T$ for the error information, the weight $C_E$ for the discrepancy degree information, and the weight $C_L$ for the loss information are not limited to be changed to the link destinations L2 situated in the temporally future direction of the link source L1 and to the link destinations L2 situated in the temporally past direction of the link source L1, but, for example, may be changed to the kinds of links.

It is a matter of course that the values of the weight $C_T$ for the error information, the weight $C_E$ for the discrepancy degree information, and the weight $C_L$ for the loss information are not limited to those shown in the formula (9), but they are arbitrary.

The CPU 171 next selects, for example, the link destination L2 having the highest evaluation in the evaluation values E, that is, having the smallest evaluation value E, out of the link destinations L2 the numbers of times of storage into the memory 18 of which are less than a predetermined threshold value among the plurality of link destinations in the reproduction data time axis changing section 13.

To put it concretely, for example, when a link destination L2 is selected by a CPU 171, which has executed the selection program 173*b*, to the link source L1 situated in the frame of the frame number F, the CPU 171 judges whether the number of the sets {F, K}, stored in the memory 18, of the frame number F, and the link number K of the link linking the link source L1 with the selected link destination L2 is less than the predetermined threshold value or not. The CPU 171 then selects the link destination L2 having the smallest evaluation value E among the link destinations L2 judged to be selected less times than the predetermined threshold value.

Incidentally, the predetermined threshold value is set to be set to each kind of link, for example.

The CPU 171 functions as the selection section by executing this selection program 173*b*.

The reproduction control program 173*c* enables the CPU 171 to realize, for example, the function of making the reproduction section R reproduce the reproduction data D recorded on the recording medium M, and of making the sound output apparatus 1*a* output the sound based on the reproduction data D.

Furthermore, the reproduction control program 173*c* enables the CPU 171 to realize, for example, the function of moving the reproduction point of the reproduction data D by the reproduction section R to the position corresponding to the link destination L2 selected by the CPU 171, which has executed the selection program 173*b*, by linking the link source L1 to the link destination L2 when the reproduction point has reached a given point to the point corresponding to the link source L1, and of making the reproduction section R reproduce the reproduction data D to make the sound output apparatus 1*a* output the sound based on the reproduction data D.

The given point may be a point corresponding to the link source L1 here, or may be a position distant from the position corresponding to the link source L1 by a given number of samples into the past direction. In the present embodiment, the given point is set to the position corresponding to the link source L1.

That is, when the reproduction point of the reproduction data D by the reproduction section R reaches the position corresponding to the link source L1, the CPU 171 makes the reproduction section R reproduce the reproduction data D so as to change the time axis of the reproduction data D without changing the pitch thereof based on the link information transferred to the memory 18, and makes the sound output apparatus 1*a* output the sound based on the reproduction data D.

To put it concretely, for example, when the reproduction point has reached the position of the link source L11 and a link destination L2 is selected by the CPU 171, which has executed the selection program 173*b*, the CPU 171 changes the time axis of the reproduction data D so that the reproduction point may move to the position of the selected link destination L2 in the reproduction data time axis changing section 13.

To put it more concretely, the CPU 171, for example, overlaps with the overlap area of the link source L1 and the overlap area of the selected link destination L2 each other by the aforesaid formula (1), and thereby changes the time axis of the reproduction data D.

The CPU 171 functions as the reproduction control section by executing this reproduction control program 173*c*.

The display control program 173*d* enables the CPU 171 to realize, for example, the function of making the display apparatus 1*b* display the sound image arrangement diagram G1, in which the link images G2 based on the link display data recorded on the recording medium M are synthesized.

To put it concretely, the CPU 171, for example, makes the reading section 11 read the link display data recorded on the recording medium M, and makes the reading section 11 output the read link display data to the link display data time axis changing section 15 through the decoder 12.

The CPU 171 next changes, for example, the time axis of the link display data according to the change of the time axis of the reproduction data D in the reproduction data time axis changing section 13, and outputs the link display data to the display apparatus 1*b* in the link display data time axis changing section 15. Thereby, the sound image arrangement diagram G1, in which the link images G2 are synthesized, corresponding to the sound output from the sound output apparatus 1*a* is led to be displayed on the display apparatus 1*b*. Incidentally, the display apparatus 1*b* displays, for example, the sound image arrangement diagram G1, which corresponds to the sounds from the past to the future including the sound at the present time which is now being output from the sound output apparatus 1*a*, and in which the link images G2 are synthesized.

An example of the sound image arrangement diagram G1, which is displayed on the display apparatus 1*b*, and in which link images G2 are synthesized, is shown in FIG. 14.

In the sound image arrangement diagram G1 shown in FIG. 14, in which the link images G2 are synthesized, for example, the abscissa axis thereof is a relative time axis including the present time as the starting point, which time axis expresses the passage of time, and the intensities of sounds are expressed by the sizes of the respective sound images B arranged along the time axis. The tone colors of the sounds (such as the component ratios of the harmonic components obtained by the aforesaid FTT analysis) are expressed by the forms of the respective sound images B, and the basic frequencies of the sounds (such as the fundamental frequencies obtained by the aforesaid cepstrum analysis) are expressed by the colors of the respective sound images B. An index S expressing the present time is expressed.

Furthermore, in the sound image arrangement diagram G1 shown in FIG. 14, in which the link images G2 are synthesized, for example, the link images G2 expressing the links linking the link sources L1 with the link destinations L2 corresponding to the link sources L1 are expressed by, for example, arrows having the starting points of the link sources.

(Reproduction Processing)

Figure 15:
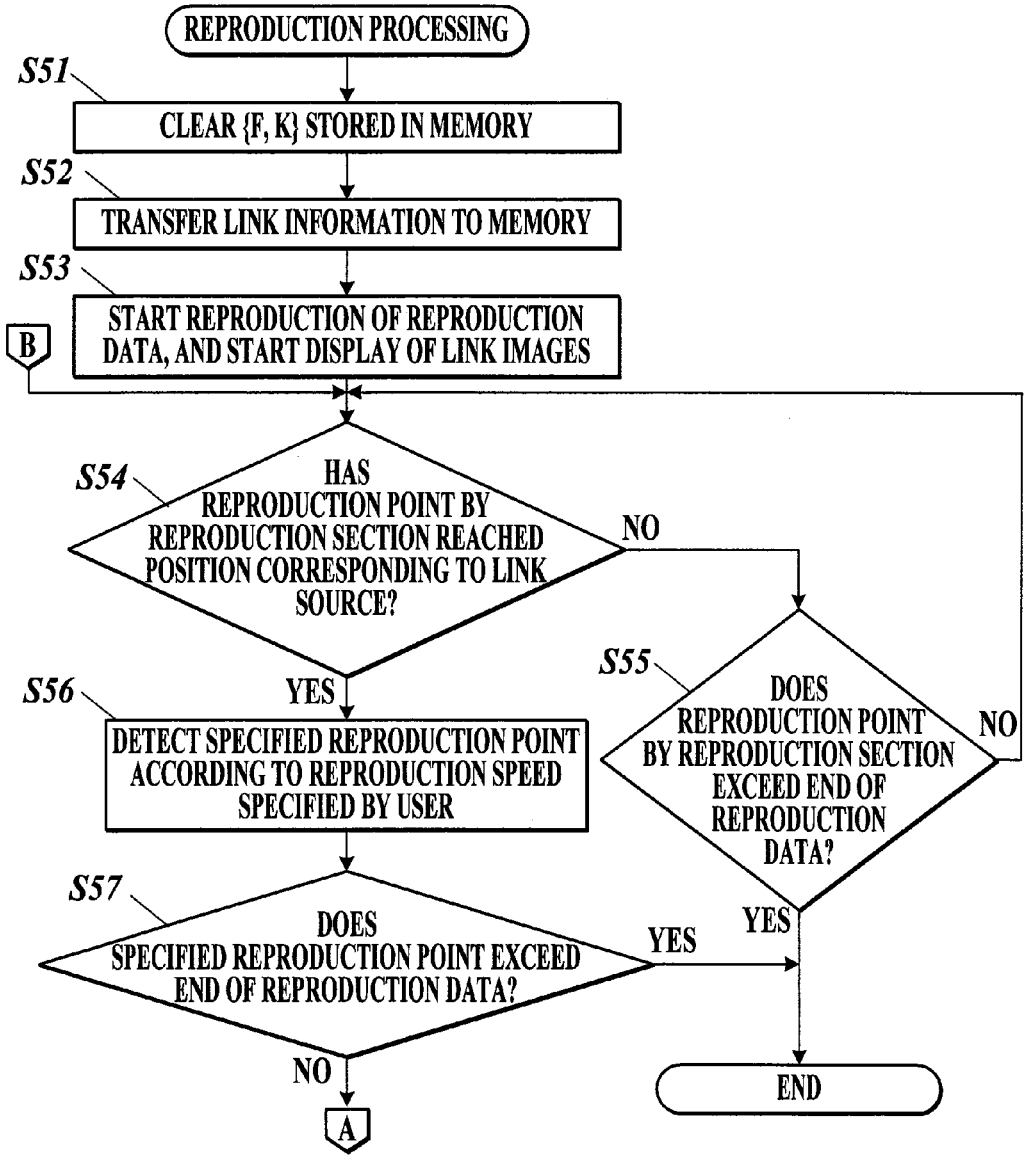
FIG. 15 is a first flow chart for illustrating a processing pertaining to the reproduction of reproduction data by the reproducing apparatus.
Figure 16:
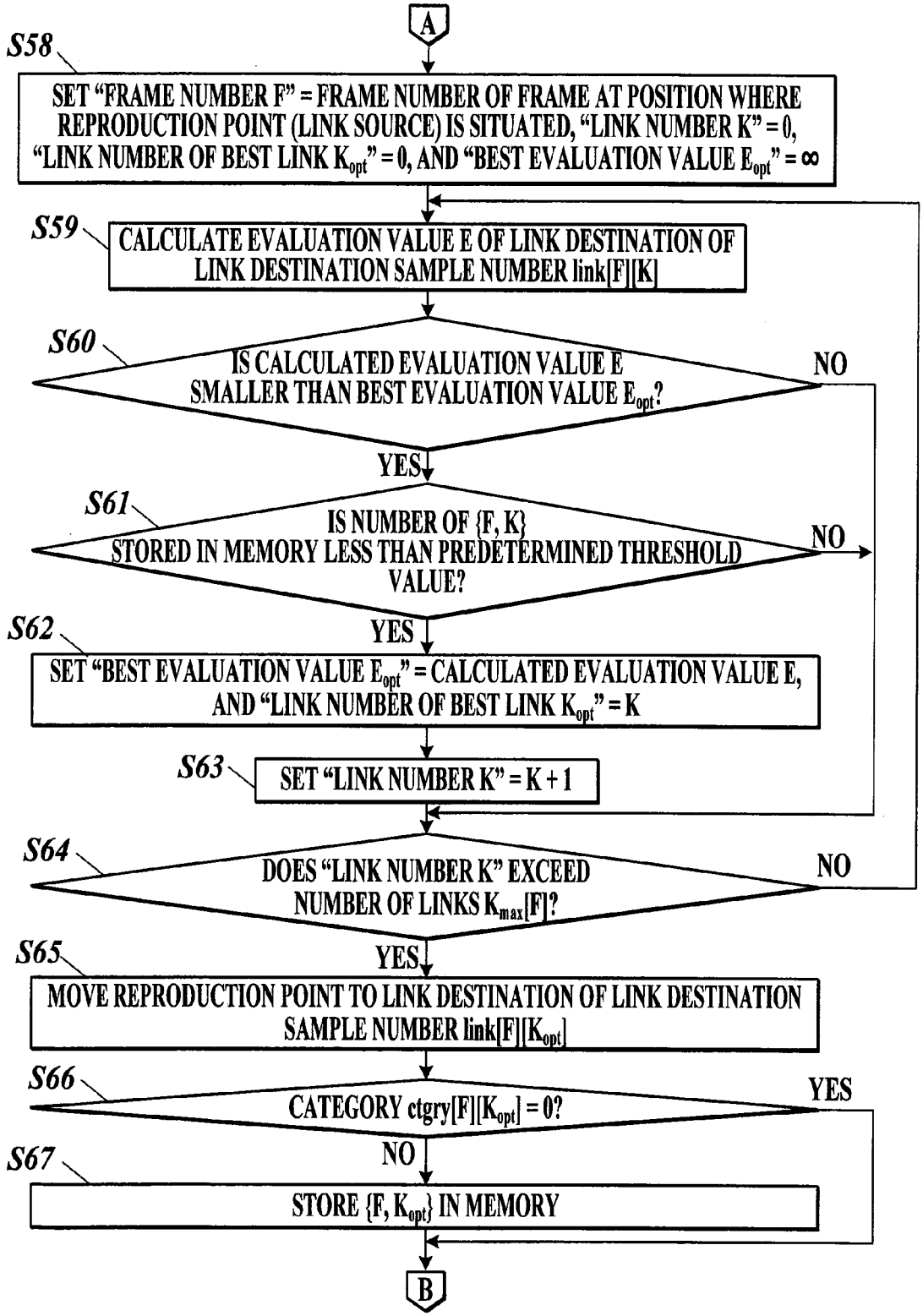
FIG. 16 is a second flow chart for illustrating the processing pertaining to the reproduction of the reproduction data by the reproducing apparatus.

The processing pertaining to the reproduction of reproduction data D by the reproducing apparatus 1 is next described with reference to the flow charts of FIGS. 15 and 16.

For example, when the reproducing apparatus 1 is instructed to reproduce the reproduction data D recorded on the recording medium M by a user's operation of the operation section 16, the CPU 171 clears the sets {F, K} stored in the memory 18 (for example, at Step S51).

The CPU 171 next makes the reading section 11 read the link information stored on the recording medium M, and makes the reading section 11 transfer the read link information to the memory 18 through the decoder 12 to store the link information in the memory 18 (Step S52).

The CPU 171 next executes the reproduction control program 173*c* to start the reproduction of the reproduction data D recorded on the recording medium M, and executes the display control program 173*d* to start the display of the link images G2 based on the link display data (the sound image arrangement diagram G1, in which the link images G2 are synthesized) (Step S53).

The CPU 171 next judges whether the reproduction point of the reproduction data D by the reproduction section R has reached the position corresponding to the link source L1 or not (Step S54).

When the CPU 171 judges that the reproduction point of the reproduction data D by the reproduction section R has not reached the position corresponding to the link source L1 at Step S54 (Step S54; No), the CPU 171 judges whether the reproduction data D by the reproduction section R exceeds the end of the reproduction data D or not (Step S55).

When the CPU 171 judges that the reproduction point of the reproduction data D by the reproduction section R exceeds the end of the reproduction data D at Step S55 (Step S55; Yes), the CPU 171 ends the present processing.

On the other hand, when the CPU 171 judges that the reproduction point of the reproduction data D by the reproduction section R does not exceed the end of the reproduction data D at Step S55 (Step S55; No), the CPU 171 repeatedly performs the processing on and after Step S54.

Moreover, when the CPU 171 judges that the reproduction point of the reproduction data D by the reproduction section R has reached the position corresponding to the link source L1 at Step S54 (Step S54; Yes), the CPU 171 executes the specified reproduction point detecting program 173*a* to detect the sample number of the specified reproduction point in the reproduction data D according to the reproduction speed at the present time which has been specified by a user's operation of the operation section 16 in the reproduction data time axis changing section 13 (Step S56).

The CPU 171 next judges whether the specified reproduction point detected by the processing at Step S56 exceeds the end of the reproduction data D or not (Step S57).

When the CPU 371 judges that the specified reproduction point detected by the processing at Step S56 exceeds the end of the reproduction data D at Step S57 (Step S57; Yes), the CPU 171 ends the present processing.

On the other hand, the CPU 171 judges that the specified reproduction point detected by the processing at Step S56 does not exceeds the end of the reproduction data D at Step S57 (Step S57; No), the CPU 171 performs the processing at Steps S58-S64 to select a link destination L2.

To put it concretely, the CPU 171 sets the "frame number of the frame in which the reproduction point (link source L1) is situated" of the reproduction data D by the reproduction section R in the "frame number F" storage area in the RAM 172; the CPU 171 sets "0" in the "link number K" storage area in the RAM 172; the CPU 171 sets "0" in the "link number of best link $K_{opt}$" storage area in the RAM 172; and the CPU 171 sets "∞" in the "best evaluation value $E_{opt}$" storage area in the RAM 172 (Step S58).

The CPU 171 next executes the selection program 173*b* to obtain the error information $E_T$ pertaining to the temporal error between the specified reproduction point detected by the processing at Step S56 and the link destination point based on the link destination sample number link[F][K] included in the link information transferred to the memory 18 by the processing at Step S52, and to calculate the evaluation value E based on the obtained error information $E_T$, the discrepancy degree information $E_E$ ($E_E$=discrepancy degree err[F][K]) included in the link information that has been transferred to the memory by the processing at Step S52, and the loss information $E_L$ ($E_L$=loss loss[F][K]) included in the link information that has been transferred to the memory 18 by the processing at Step S52, to the link destination L2 of the link destination sample number link[F][K] in the reproduction data time axis changing section 13 (Step S59).

The CPU 371 next judges whether the evaluation value E calculated by the processing at Step S59 is smaller than the value stored in the "best evaluation value $E_{opt}$" area in the RAM 172 (best evaluation value $E_{opt}$) or not (Step S60).

When the CPU 171 judges that the evaluation value E calculated by the processing at Step S59 is not smaller than the value stored in the "best evaluation value $E_{opt}$" area in the RAM 172 (best evaluation value $E_{opt}$) (Step S60; No), the CPU 171 moves the processing thereof to that at Step S64.

On the other hand, when the CPU 171 judges that the evaluation value E calculated by the processing at Step S59 is smaller than the value stored in the "best evaluation value $E_{opt}$" area in the RAM 172 (best evaluation value $E_{opt}$) at Step S60 (Step S60; Yes), the CPU 171 judges whether the number of the sets {F, K} stored in the memory 18 is less than the predetermined threshold value or not (Step S61).

When the CPU 171 judges that the number of the sets {F, K} stored in the memory 18 is not less than the predetermined threshold value at Step S61 (Step S61; No), the CPU 171 moves the processing thereof to that at Step S64.

On the other hand, when the CPU 171 judges that the number of the sets {F, K} stored in the memory 18 is less than the predetermined threshold value at Step S61 (Step S61; Yes), the CPU 171 sets the evaluation value E calculated by the processing at Step S59 in the "best evaluation values $E_{opt}$" storage area in the RAM 172, and sets the value set in the "link number K" storage area in the RAM 172 (link number K) into the "link number of best link $K_{opt}$" storage area in the RAM 172 (Step S62).

The CPU 171 next sets "K+1" into the "link number K" storage area in the RAM 172 (Step S63), and judges whether the value stored in the "link number K" storage area in the RAM 172 (link number K) exceeds the number of links Kmax[F] included in the link information transferred to the memory 18 by the processing at Step S52 or not (Step S64).

When the CPU 171 judges that the value stored in the "link number K" storage area in the RAM 172 (link number K) does not exceed the number of links Kmax[F] included in the link information at Step S64 (Step S64; No), the CPU 171 performs the processing on and after Step S59 repeatedly.

On the other hand, when the CPU 171 judges that the value stored in the "link number K" storage area in the RAM 172 (link number K) exceeds the number of links Kmax[F] included in the link information at Step S64 at Step S64 (Step S64; Yes), the CPU 171 executes the reproduction control program 173*c* to move the reproduction point of the reproduction data D by the reproduction section R to the link destination L2 of the link destination sample number link[F][$K_{opt}$] (Step S65).

To put it concretely, the CPU 171 makes the overlap area of the reproduction point (link source L1) of the reproduction data D by the reproduction section R and the overlap area of the link destination L2 of the link destination sample number link[F][$K_{opt}$] overlap with each other.

The CPU 171 next judges whether the category ctgry[F][$K_{opt}$] included in the link information transferred to the memory 18 by the processing at Step S52 is the category ctgry[F][$K_{opt}$]=0 (equivalence link) or not (Step S66).

When the CPU 171 judges that the category ctgry[F][$K_{opt}$] is the category ctgry[F][$K_{opt}$]=0 (equivalence link) at Step S66 (Step S66; Yes), the CPU 171 performs the processing on and after Step S54 repeatedly.

On the other hand, the CPU 171 judges that the category ctgry[F][$K_{opt}$] is not the category ctgry[F][$K_{opt}$]=0 (equivalence link) at Step S66 (Step S66; No), the CPU 171 makes the memory 18 store the set {F, $K_{opt}$} (Step S67), and performs the processing on and after Step S54 repeatedly.

According to the reproducing apparatus 1 of the first embodiment described above, the reproduction data D of sound data can be reproduced by the reproduction section R; the evaluation value E between a link source L1 and each link destination L2 is calculated by a previously determined given arithmetic expression based on the link information pertaining to a plurality of link destinations L2 corresponding to the link source L1 set to the production data D in advance, and the link destination L2 having the highest evaluation in the evaluation values E can be selected out of the plurality of link destinations L2 by the CPU 171, which has executed the selection program 173*b*; when the reproduction point of the reproduction data D by the reproduction section R has reached the position corresponding to the link source L1, the reproduction point is moved to the position corresponding to the link destination L2 by linking the link source L1 with the link destination L2 selected by the CPU 171, which has executed the selection program 173*b*, and the reproduction data can be reproduced by the reproduction section R under the control of the CPU 171, which has executed the reproduction control program 173*c*.

That is, because the reproduction data D (sound data) can be reproduced based on the previously set link information, the time axis of the reproduction data D is changed without changing the pitch of the reproduction data D with the calculation load at the reproduction suppressed, and then the reproduction point can be moved. Furthermore, because the optimum link destination L2 can be selected out of the plurality of link destinations L2 based on the link information, the variable speed reproduction of the reproduction data D can be performed in the state of being easy for a user to perform looking and listening.

Moreover, a user can specify the reproduction speed of the reproduction data D with the operation section 16. The link information includes link destination position information (link destination sample number link[F][K]) pertaining to the position of a link destination L2 in the reproduction data D, discrepancy degree information $E_E$ ($E_E$=discrepancy degree err[F][K]) pertaining to the discrepancy degree of the waveforms of the link source L1 and the link destination L2, and loss information $E_L$ ($E_L$=loss loss[F][K]) pertaining to the loss of the signal energy produced by the movement of a reproduction point from the link source L1 to the link destination L2. The CPU 171, which has executed the selection program 173*b*, obtains error information $E_T$ pertaining to the temporal error between a specified reproduction point in the reproduction data D according to a reproduction speed specified by a user's operation of the operation section 16 and a link destination point based on link destination position information (link destination sample number link[F][K]) included in the link information, and can calculate the evaluation value E based on the obtained error information $E_T$, the discrepancy degree information $E_E$ included in the link information, and the loss information $E_L$ included in the link information.

Consequently, because the optimum link destination L2 is selected to reproduce the reproduction data D by considering the error information $E_T$ (the temporal error between the link destination L2 and the specified reproduction point), the discrepancy degree information $E_E$ (the discrepancy degree between the waveforms of the overlap areas of the link source L1 and the overlap areas of the link destination L2), and the loss information $E_L$ (the loss of the signal energy caused by the movement of the reproduction point), the reproduction data D can be reproduced in the state in which a user can more easily perform looking and listening.

Moreover, the evaluation values E is the sum of the product of the error information $E_T$ and the weight $C_T$ for the error information settable to the error information $E_T$, the product of the discrepancy degree information $E_E$ and the weight $C_E$ for the discrepancy degree information settable to the discrepancy degree information $E_E$, and the product of the loss information $E_L$ and the weight $C_L$ for the loss information settable to the loss information $E_L$. The link destination L2 having the highest evaluation in the evaluation values E is the one having the smallest evaluation value E.

Consequently, because a weight is settable to each of the error information $E_T$, the discrepancy degree information $E_E$, and the loss information $E_L$, a link destination L2 according to the taste of a user can be determined by setting the weights according to the taste of the user.

Moreover, different weights $C_T$ for the error information are settable to the error information $E_T$ obtained from the link information pertaining to a link destination L2 situated in the temporally future direction of a link source L1 and the error information $E_T$ obtained from the link information pertaining to a link destination L2 situated in the temporally past direction of the link source L1. Different weights $C_E$ for the discrepancy degree information are settable to the discrepancy degree information $E_E$ included in the link information pertaining to a link destination L2 situated in the temporally future direction of a link source L1 and the discrepancy degree information $E_E$ included in the link information pertaining to a link destination L2 situated in the temporally past direction of the link source L1. Different weights $C_L$ for the loss information are settable to the loss information $E_L$ included in the link information pertaining to a link destination L2 situated in the temporally future direction of a link source L1 and the loss information $E_L$ included in the link information pertaining to a link destination L2 situated in the temporally past direction of the link source L1.

Consequently, because different weights are settable in the case of selecting a link destination L2 situated in the temporally future direction of the link source L1 (that is, in the case of performing the high speed reproduction of the reproduction data D) and in the case of selecting a link destination L2 situated in the temporally past direction of the link source L1 (that is, in the case of performing the slow speed reproduction of the reproduction data D, a link destination L2 more fitted to the taste of a user can be determined.

Moreover, the number of times of the selection of each of the link destinations L2 by the CPU 171, which has executed the selection program 173*b*, can be stored with the memory 18. The CPU 171, which has executed the selection program 173*b*, can select a link destination L2 having the highest evaluation in the evaluation values E out of the link destinations L2 having the number of times stored in the memory 18 (the number of sets {F, K} stored in the memory 18) which number is less than a predetermined threshold value among a plurality of link destinations L2.

Consequently, because it can be prevented to select the same link destination L2 repeatedly, a user can perform looking and listening without feeling any discomfort.

Moreover, the reproduction data D is recorded on the recording medium M together with the link information set to the reproduction data D in advance.

Consequently, the reproduction data D can be reproduced based on the link information recorded on the recording medium M.

Moreover, the link images G2 based on the link display data for displaying the temporal association between the link source L1 produced based on the link information and each link destination L2 can be displayed on the display apparatus 1*b* by the CPU 171, which has executed the display control program 173*d*.

That is, because links can be displayed to a user in their visualized forms, the user can know in advance which positions of reproduction data the links are provided at. Consequently, the visualization of the links makes usability better.

To put it concretely, for example, the provision of subjective links enables a user to command a panoramic view of how unimportant time sections are distributed in the reproduction data D, and supports the operations of the user.

Moreover, the link information of a link source L1 includes the simple link information expressing a minimum discrepancy degree point at which the discrepancy degree err[F][K] is smallest as a link destination L2 among arbitrary points situated in a given retrieval range around the position of the link source L1.

That is, because the link based on the simple link information is the one having the smallest discrepancy degree between the waveform of the overlap area of the link source L1 and the waveform of the overlap area of the link destination L2, the use of the link enables the keeping of the continuity of the waveform of the reproduction data D to be suitable even when the reproduction point is moved, and thus the outputting of unpleasant sounds caused by the movement of the reproduction point can be suppressed.

Moreover, when a link source L1 is situated in a silence area of the reproduction data D, the link information of the link source L1 includes the in-silence link information expressing the starting point MA[m] and the ending point MB[m] of the silence area as link destinations L2.

That is, because the links based on the in-silence link information are ones for moving in the silence area, the use of the links enable, for example, the omission of the silence area at the time of high speed reproduction, or the spending of time in the silence area at the time of slow speed reproduction, and consequently the in-silence link information is effective.

Moreover, when a link source L1 is situated in a silence area in the reproduction data D, the link information of the link source L1 includes the inter-silence link information expressing an ending point MB[m] in a silence area different from the former silence area in the reproduction data D as a link destination L2.

That is, because the link based on the inter-silence link information is one for moving between different silence areas, the use of the link enables, for example, the omission of one word at the time of high speed reproduction, and the like, and consequently the inter-silence link information is effective.

Moreover, when a link source L1 is situated in the starting point NB[n] or the ending point NB[n] in a periodic sound area of the reproduction data D, the link information of the link source L1 includes the periodic sound link information expressing the ending point NB[n] and the starting point NB[n] of the periodic sound area as link destinations L2, respectively.

That is, because a link based on the periodic sound link information is one in a periodic sound area, the used of the link enables, for example, the omission of a periodic sound area at the time of high speed reproduction, or the spending of time in a periodic sound area at the time of slow speed reproduction. Consequently, the use of the link is effective.

Moreover, the link information of a link source L1 includes subjective link information expressing a specified link destination specified by a user as a link destination L2.

That is, because a link based on the subjective link information is one provided by a user based on subjective judgment, the use of the link enables, for example, the reproduction of an area that the user judges to be important without any omission, or the omission of an area that the user judges to be unnecessary. Consequently, the use of the link is effective.

[Second Embodiment]

Next, a reproducing apparatus 1A of a second embodiment will be described.

Incidentally, the reproducing apparatus 1A of the second embodiment is an apparatus composed of the link information producing apparatus 3 and the link display data producing apparatus 5 in addition to the reproducing apparatus 1 of the first embodiment. Accordingly, only different points are described, and the other common parts are described by denoting the same reference marks.

<Reproducing Apparatus>

The reproducing apparatus 1A, for example, produces link information based on the reproduction data D composed of the sound data recorded on the given recording medium MA to record the produced link information on the recording medium MA. The reproducing apparatus 1A then reproduces the reproduction data D recorded on the recording medium MA based on the link information recorded on the recording medium MA, and at the same time the reproducing apparatus 1A produces link display data based on the reproduction data D and the link information, both recorded on the recording medium MA, to display the produced link display data.

Figure 17:
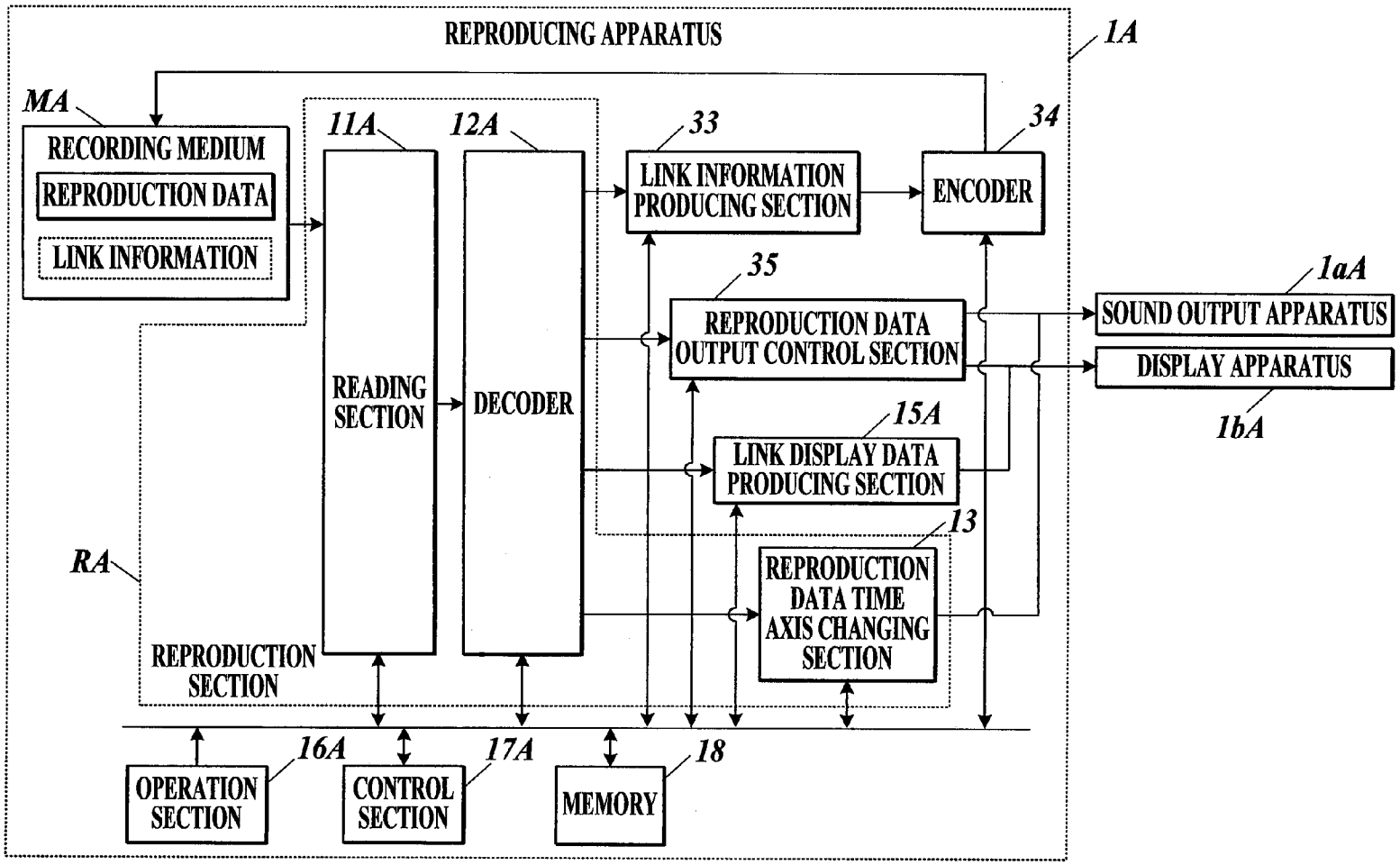
FIG. 17 is a block diagram showing the functional configuration of a reproducing apparatus of a second embodiment.

To put it concretely, the reproducing apparatus 1A comprises, for example, a reproduction section RA provided with a reading section 11A, a decoder 12A, and the reproduction data time axis changing section 13; the link information producing section 33; the encoder 34; the reproduction data output control section 35; a link display data producing section 15A, an operation section 16A, a control section 17A, and the memory 18, as shown in FIG. 17.

Moreover, the reproducing apparatus 1A is connected to, for example, a sound output apparatus 1*a*A through the reproduction data output control section 35 and the reproduction data time axis changing section 13, and a display apparatus 1*b*A through the reproduction data output control section 35 and the link display data producing section 15A.

The sound output apparatus 1*a*A includes, for example, the function of the sound output apparatus 1*a* connected to the reproducing apparatus 1 of the first embodiment, the function of the sound output apparatus 3*a* connected to the link information producing apparatus 3, and the like.

The display apparatus 1*b*A includes, for example, the function of the display apparatus 1*b* connected to the reproducing apparatus 1 of the first embodiment, the function of the display apparatus 3*b* connected to the link information producing apparatus 3, and the like.

The reading section 11A includes, for example, the function of the reading apparatus 11 of the reproducing apparatus of the first embodiment, the function of the reading section n31 of the link information producing apparatus 3, the reading section 51 of the link display data producing apparatus 5, and the like.

The decoder 12A includes, for example, the function of the decoder 12 of the reproducing apparatus 1 of the first embodiment, the function of the decoder 32 of the link information producing apparatus 3, the function of the decoder 52 of the link display data producing apparatus 5, and the like.

The link display data producing section 15A includes, for example, the function of the link display data time axis changing section 15 of the reproducing apparatus 1 of the first embodiment, the function of the link display data producing section 53 of the link display data producing apparatus 5, and the like.

The operation section 16A includes, for example, the function of the operation section 16 of the reproducing apparatus 1 of the first embodiment, the function of the operation section 36 of the link information producing apparatus 3, the function of the operation section 56 of the link display data producing apparatus 5, and the like.

Figure 18:
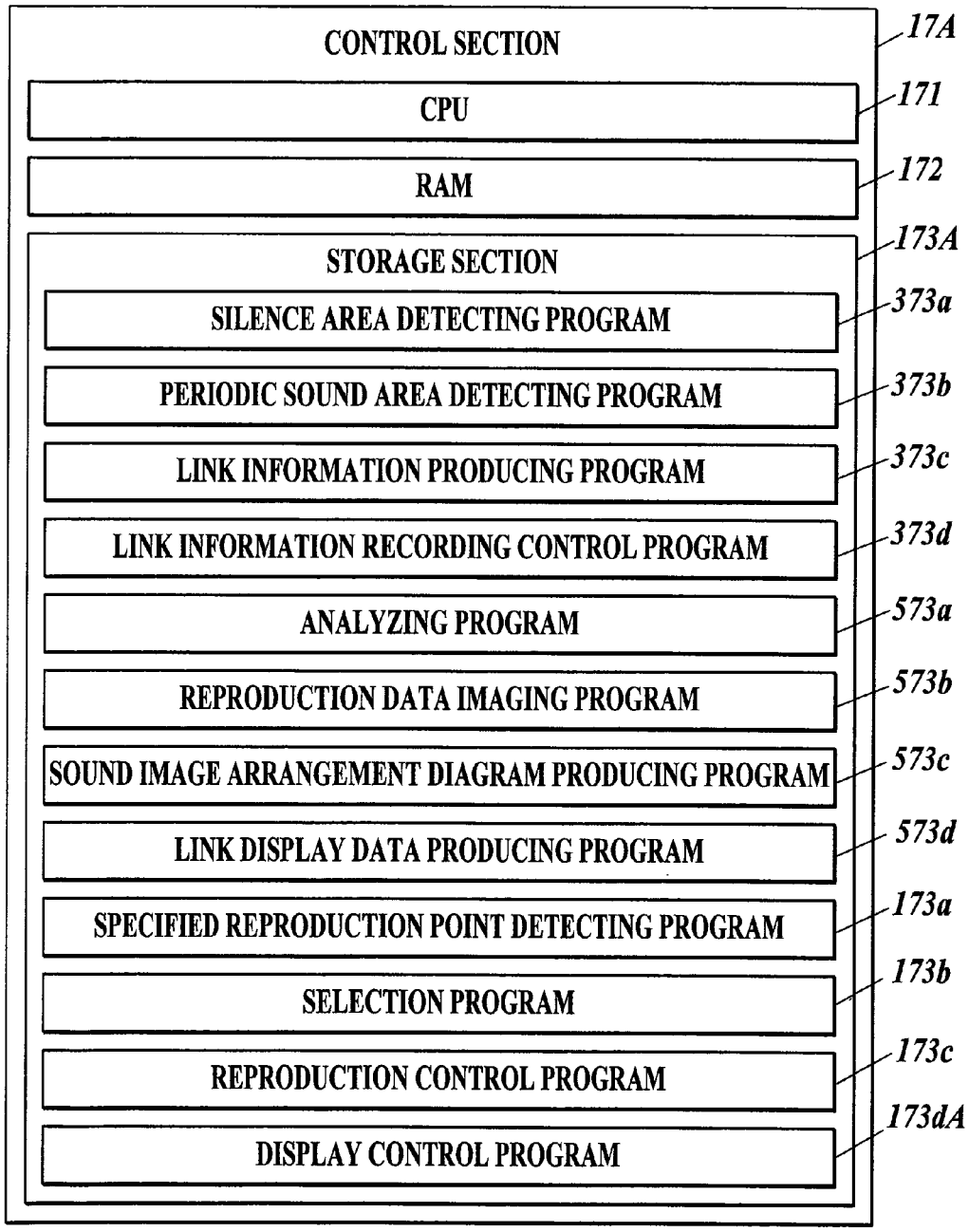
FIG. 18 is a block diagram showing the functional configuration of the control section shown in FIG. 17.

The control section 17A comprises, for example, the CPU 171, the RAM 172, and a storage section 173A, as shown in FIG. 18.

The storage section 173A stores, for example, a system program executable in the reproducing apparatus 1A, the various processing programs executable on the system program, the data to be used at the time of the execution of the various processing programs, and the data of the processing results of arithmetic processing executed by the CPU 171. Incidentally, the programs are stored in the storage section 173A in the forms of the program codes readable by a computer.

To put it concretely, the storage section 173A stores, for example, the silence area detecting program 373*a*, the periodic sound area detecting program 373*b*, the link information producing program 373*c*, the link information recording control program 373*d*, the analyzing program 573*a*, the reproduction data imaging program 573*b*, the sound image arrangement diagram producing program 573*c*, the link display data producing program 573*d*, the specified reproduction point detecting program 173*a*, the selection program 173*b*, the reproduction control program 173*c*, and a display control program 173*d*A, as shown in FIG. 18.

The link information producing section for producing link information is here composed of, for example, the link information producing section 33, the CPU 171, which has executed the silence area detecting program 373*a*, the CPU 171, which has executed the periodic sound area detecting program 373*b*, and the CPU 171, which has executed the link information producing program 373*c*.

The display control program 173*d*A enables the CPU 171 to realize, for example, the function of making the display apparatus 1*b*A display the sound image arrangement diagram G1, in which the link images G2 are synthesized, based on the link display data produced in the link display data producing section 15A by the CPU 171, which has executed the link display data producing program 573*d*.

Because the reproducing apparatus 1A of the second embodiment described above is provided with the link information producing section 33 for producing link information, the CPU 171, which has executed the silence area detecting program 373*a*, the CPU 171, which has executed the periodic sound area detecting program 373*b*, the CPU 171, which has executed the link information producing program 373*c*, the reproducing apparatus 1A can produce link information, and can reproduce the reproduction data D based on the link information.

Moreover, the reproducing apparatus 1A can produce subjective link information even at the time of the reproduction of the reproduction data D.

That is, for example, when fast-forward reproduction is executed by a user at the time of the reproduction of the reproduction data D, the subjective link can be provided so as to omit the area in which the fast-forward reproduction is performed.

In this case, the subject link is preferably determined to be provided from the link source L1 in a frame situated most closely to the position where the fast-forward reproduction has been started, and the position where the fast-forward reproduction has ended is preferably changed to the position situated in a given scope around the position where the fast-forward reproduction has ended, at which position to be changed the discrepancy degree err[F][K] of the waveform to that of the link source L1 determined to be provided with the subjective link becomes smaller. Moreover, in this case, the loss loss[F][K] may be a value input by a user, a value previously set for the subjective link to be produced at the time of fast-forward reproduction, or a value set to each user who performs the fast-forward reproduction.

Moreover, because the reproducing apparatus 1A can produce the reproduction data D to display it at the time of the reproduction thereof, it is unnecessary to produce any link display data in advance.

Incidentally, the present invention is not limited to the embodiments described above, but can be suitably modified without departing from the scope of the spirit thereof.

In the first and the second embodiments, the reproduction data D is not limited to be composed of only the sound data, but may be composed of sound data and image data. In this case, not only the link information pertaining to the sound data, but also the link information pertaining to the image data may be produced to change the time axis of the sound data and the time axis of the image data differently from each other. Alternatively, only the link information pertaining to the sound data may be produced to change the time axis of the image data accordingly to the change of the time axis of the sound data.

Moreover, in the first and second embodiments, the reproduction data D may be composed of only image data. In this case, it is necessary to produce the link information pertaining to the image data in place of the link information pertaining to the sound data.

In the first and second embodiments, the link information is not limited to include the link destination position information (link destination sample number link[F][K]), the discrepancy degree information (discrepancy degree err[F][K]), and the loss information (loss loss[F][K]), but the link information is arbitrary as long as the information enables the calculation of an evaluation value between a link source and each link destination based on the link information by a previously determined given arithmetic expression, and the selection of a link destination having the highest evaluation among the evaluation values out of the plurality of link destinations.

In the first and second embodiments, a reproduction speed may be calculated based on the reproduction time of the reproduction data D specified by a user to detect the specified reproduction point.

That is, for example, when a user specifies to reproduce the reproduction data D for an hour for fifteen minutes by an operation of the operation section 16 or 16A, the specified reproduction point may be detected as setting the reproduction speed specified by the user's operation of the operation section 16 or 16A is "quad speed" to select a link destination L2 then, and the reproduction point may be moved to the selected link destination L2 to reproduce the reproduction data D. The reproducing apparatus 1 and 1A can thus perform digest reproduction of the reproduction data D in the state easy for the user to look at and listen to.

In the first embodiment, the reproducing apparatus 1 and the link information producing apparatus 3 may not be separate bodies, but may be an integrated body. In this case, subjective link information can be produced even during the reproduction of the reproduction data D.

In the first embodiment, the reproducing apparatus 1 and the link display data producing apparatus 5 may not be separate bodies, but may be an integrated body. In this case, it is unnecessary to produce the link display data in advance, and the link display data can be produced to be displayed at the time of the reproduction of the reproduction data D.

In the first and second embodiments, the link images G2 is neither needed to be synthesized to the sound image arrangement diagram G1 as shown in FIG. 14, nor to be the arrows having the starting point of the link source L1. As long as the images can visualize the temporal association between a link source L1 and each link destination L2, the like images may be arbitrary, for example, may be a graph and the like.

According to a first aspect of the preferred embodiments of the present invention, there is provided a reproducing apparatus comprising:

a reproduction section to reproduce reproduction data comprising sound data and/or image data;

a selection section to calculate evaluation values between a link source which is previously set for the reproduction data and each of a plurality of link destinations corresponding to the link source by a predetermined arithmetic expression based on link information pertaining to the plurality of link destinations, and to select a link destination having a highest evaluation among the evaluation values out of the plurality of link destinations;

a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data;

a specification section to specify a reproduction speed of the reproduction data; and a storage section to store the number of times of selecting each of the link destinations by the selection section, wherein the link information comprises:

link destination position information pertaining to the position of the link destination in the reproduction data;

discrepancy degree information pertaining to a discrepancy degree between a waveform of the link source and a waveform of the link destination; and loss information pertaining to a loss of signal energy caused by moving the reproduction point from the link source to the link destination, and wherein the selection section obtains error information pertaining to a temporal error between a specified reproduction point according to the reproduction speed specified by the specification section in the reproduction data and a link destination point based on the link destination position information included in the link information, calculates the evaluation values, each evaluation value being a sum of a product of the obtained error information and a weight for the error information set in the error information, a product of the discrepancy degree information included in the link information and a weight for the discrepancy degree information set in the discrepancy degree information, and a product of the loss information included in the link information and a weight for the loss information set in the loss information, and selects the link destination having a smallest evaluation value out of the link destinations each of which having the number of times which is stored in the storage section and which is less than a predetermined threshold value, among the plurality of link destinations.

According to a first aspect of the present invention, evaluation values between a link source previously set to reproduction data and a plurality of respective link destinations corresponding to the link source are calculated by a previously determined given arithmetic expression based on link information pertaining to the plurality of link destinations, and a link destination having a highest evaluation among the evaluation values can be selected out of the plurality of link destinations by the selection section. A reproduction point of the reproduction data by a reproduction section is moved to a position corresponding to the link destination selected by the selection section by linking the link source to the link destination when the reproduction point reaches a given point to a position corresponding to the link source, and the reproduction section can be made to reproduce the reproduction data, by the reproduction control section.

That is, because the reproduction data can be reproduced based on the previously set link information, the calculation load at the time of reproduction can be suppressed. Furthermore, because the optimum link destination can be selected out of the plurality of link destinations based on the link information, the variable speed reproduction of the reproduction data can be performed in the sate easy for a user to perform looking and listening.

Moreover, a number of times of selection of each of the link destinations by the selection section can be stored by a storage section. The link information includes link destination position information pertaining to a position of the link destination in the reproduction data, discrepancy degree information pertaining to a discrepancy degree between a waveform of the link source and a waveform of the link destination, and loss information pertaining to a loss of signal energy caused by the movement of the reproduction point from the link source to the link destination. The selection section can select a link destination having a smallest evaluation value out of link destinations having the numbers of times less than a predetermined threshold value, the numbers of times stored in the storage section, among the plurality of link destinations, by obtaining error information pertaining to a temporal error between a specified reproduction point according to a reproduction speed specified by the specification section in the reproduction data and a link destination point based on the link destination position information included in the link information, and by calculating the evaluation values, each being a sum of a product of the obtained error information and a weight for the error information set in the error information, a product of the discrepancy degree information included in the link information and a weight for the discrepancy degree information set in the discrepancy degree information, and a product of the loss information included in the link information and a weight for the loss information set in the loss information.

Consequently, the reproduction data is reproduced by selecting the optimum link destination in consideration of the error information (the temporal error between the link destination and the specified reproduction point), the discrepancy degree information (the discrepancy degree between the waveform of the link source and that of the link destination), and the loss information (the loss of the signal energy caused by the movement of the reproduction point). Hence, the reproduction data can be reproduced in the state easier for a user to perform looking and listening.

Moreover, because it is possible to set the weight to each of the error information, the discrepancy degree information, and the loss information, the link destination according to the taste of a user can be determined by setting the weights according to the taste of the user.

Moreover, because it is possible to select the link destination having the smallest evaluation value out of the link destinations having the number of times stored in the storage section less than the predetermined threshold value, it can be prevented to select the same link destination repeatedly. A user can then perform looking and listening without feeling any discomfort.

According to a second aspect of the preferred embodiments of the present invention, there is provided a reproducing apparatus comprising:

a reproduction section to reproduce reproduction data comprising sound data and/or image data;

a selection section to calculate evaluation values between a link source which is previously set for the reproduction data and each of a plurality of link destinations corresponding to the link source by a predetermined arithmetic expression based on link information pertaining to the plurality of link destinations, and to select a link destination having a highest evaluation among the evaluation values out of the plurality of link destinations; and a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data.

According to a second aspect of the present invention, evaluation values between a link source previously set to reproduction data and a plurality of respective link destinations corresponding to the link source are calculated by a previously determined given arithmetic expression based on link information pertaining to the plurality of link destinations, and a link destination having a highest evaluation among the evaluation values can be selected out of the plurality of link destinations by the selection section. A reproduction point of the reproduction data by a reproduction section is moved to a position corresponding to the link destination selected by the selection section by linking the link source to the link destination when the reproduction point reaches a given point to a position corresponding to the link source, and the reproduction section can be made to reproduce the reproduction data, by the reproduction control section.

That is, because the reproduction data can be reproduced based on the previously set link information, the calculation load at the time of reproduction can be suppressed. Furthermore, because the optimum link destination can be selected out of the plurality of link destinations based on the link information, the reproduction data can be reproduced in the sate easy for a user to perform looking and listening.

Preferably, the reproducing apparatus comprises a specification section to specify a reproduction speed of the reproduction data, wherein the link information comprises:

link destination position information pertaining to the position of the link destination in the reproduction data;

discrepancy degree information pertaining to a discrepancy degree between a waveform of the link source and a waveform of the link destination; and loss information pertaining to a loss of signal energy caused by moving the reproduction point from the link source to the link destination, and wherein the selection section obtains error information pertaining to a temporal error between a specified reproduction point according to the reproduction speed specified by the specification section in the reproduction data and a link destination point based on the link destination position information included in the link information, and calculates the evaluation values based on the obtained error information and at least one piece of the discrepancy degree information and the loss information, both of which are included in the link information.

According to a third aspect of the present invention, it is a matter of course that the advantages similar to those of the second aspect, the selection section obtains error information pertaining to a temporal error between a specified reproduction point according to a reproduction speed specified by the specification section in the reproduction data and a link destination point based on the link destination position information included in the link information, and can calculate the evaluation values based on the obtained error information and at least one piece of the discrepancy degree information and the loss information, both included in the link information.

Consequently, the reproduction data is reproduced by selecting the optimum link destination in consideration of the error information (the temporal error between the link destination and the specified reproduction point), and the discrepancy degree information (the discrepancy degree between the waveform of the link source and that of the link destination) or the loss information (the loss of the signal energy caused by the movement of the reproduction point). Hence, the reproduction data can be reproduced in the state easier for a user to perform looking and listening.

Preferably, each of the evaluation values is a sum of a product of the error information and a weight for the error information settable in the error information, and at least one of a product of the discrepancy degree information and a weight for the discrepancy degree information settable in the discrepancy degree information and a product of the loss information and a weight for the loss information settable in the loss information, and wherein the link destination having the highest evaluation among the evaluation values is the link destination having a smallest evaluation value.

According to a fourth aspect of the present invention, it is a matter of course that the advantages similar to those of the second or third aspect, and each of the evaluation values is a sum of a product of the error information and a weight for the error information settable in the error information, and at least one of a product of the discrepancy degree information and a weight for the discrepancy degree information settable in the discrepancy degree information and a product of the loss information and a weight for the loss information settable in the loss information.

Consequently, because it is possible to set the weight to each of the error information, the discrepancy degree information, and the loss information, the link destination according to the taste of a user can be determined by setting the weights according to the taste of the user.

Preferably, different weights for the error information are settable to the error information obtained from the link information pertaining to the link destinations existing in a temporally future direction compared to the link source, and to the error information obtained from the link information pertaining to the link destinations existing in a temporally past direction compared to the link source, wherein different weights for the discrepancy degree information are settable to the discrepancy degree information included in the link information pertaining to the link destinations existing in the temporally future direction compared to the link source, and to the discrepancy degree information included in the link information pertaining to the link destinations existing in the temporally past direction compared to the link source, and wherein different weights for the loss information are settable to the loss information included in the link information pertaining to the link destinations existing in the temporarily future direction compared to the link source, and to the loss information included in the link information pertaining to the link destinations existing in the temporarily past direction compared to the link source.

According to a fifth aspect of the present invention, it is a matter of course that the advantages similar to those of the fourth aspect. Moreover, different weights for the error information can be set to error information obtained from the link information pertaining to link destinations existing in temporally future direction to the link source, and to error information obtained from the link information pertaining to link destinations existing in temporally past direction to the link source; different weights for the discrepancy degree information can be set to discrepancy degree information included in the link information pertaining to the link destinations existing in the temporally future direction to the link source, and to discrepancy degree information included in the link information pertaining to the link destinations existing in the temporally past direction to the link source; and different weights for the loss information can be set to loss information included in the link information pertaining to the link destinations existing in the temporarily future direction to the link source, and to loss information included in the link information pertaining to the link destinations existing in the temporarily past direction to the link source.

Consequently, because the different weights can be set in the case of selecting the link destinations existing in the temporally future direction to the link source (that is, the case of high speed reproduction of the reproduction data) and in the case of selecting the link destinations in the temporally past direction to the link source (that is, the case of slow speed reproduction of the reproduction data), the link destination more fitted to the taste of a user can be determined.

Preferably, the reproducing apparatus further comprises a storage section to store the number of times of selecting each of the link destinations by the selection section, wherein the selection section selects the link destination having the highest evaluation in the evaluation values out of the link destinations each of which having the number of times which is stored in the storage section and which is less than a predetermined threshold value, among the plurality of link destinations.

According to a sixth aspect of the present invention, it is a matter of course that the advantages similar to those of any one of the second to fifth aspects can be obtained. Moreover, a number of times of selection of each of the link destinations by the selection section can be stored by a storage section, and the selection section can sect the link destination having the highest evaluation in the evaluation values out of the link destinations having the numbers of times less than the predetermined threshold value, the numbers of times stored in the storage section, among the plurality of link destinations.

Consequently, because it can be prevented to repeatedly select the same link destination, a user can perform looking and listening without feeling any discomfort.

Preferably, the reproduction data is recorded on a given recording medium together with the link information set in advance to the reproduction data.

According to a seventh aspect of the present invention, it is a matter of course that the advantages similar to those of any one of the second to sixth aspects. Moreover, the reproduction data is recorded on a given recording medium together with the link information set in advance to the reproduction data.

Consequently, the reproduction data can be reproduced based on the link information recorded on the recording medium.

Preferably, the reproducing apparatus further comprises a display control section to instruct a display apparatus to display a link image based on link display data produced based on the link information in order to display a temporal association between the link source and each of the link destinations.

According to an eighth aspect of the present invention, it is a matter of course that the advantages similar to those of any one of the second to seventh aspects can be obtained. Moreover, it is possible to make a display apparatus display a link image based on link display data produced based on the link information for displaying temporal association between the link source and the each of the link destinations by a display control section.

That is, because links can be visualized to be provided to a user, it is possible to enable the user to command a panoramic view of which positions of the reproduction data the links are provided at in advance, and the visualization supports the user's operations. Consequently, the usability of the aspect is good.

Preferably, the link information of the link source comprises simple link information which expresses a minimum discrepancy degree point as the link destination, the minimum discrepancy degree point having a smallest discrepancy degree based on discrepancy degree information among arbitrary points existing within a given retrieval range from a position of the link source.

According to a ninth aspect of the present invention, it is a matter of course that the advantages similar to those of any one of the second to eighth aspects can be obtained. Moreover, the link information of the link source includes simple link information expressing a minimum discrepancy degree point as the link destination, the minimum discrepancy degree point having a smallest discrepancy degree based on the discrepancy degree information among arbitrary points existing within a given retrieval range around a position of the link source.

That is, because the link based on the simple link information is the one having a small discrepancy degree between the waveform of the link source and the waveform of the link destination, it becomes possible to suitably keep the continuity of the waveform of the reproduction data at the time of using the link even when the reproduction point is moved. Consequently, the output of unpleasant sounds, which are produced by the movement of a reproduction point, can be suppressed.

Preferably, the reproduction data is the sound data, and when the link source is situated in a silence area in the reproduction data, the link information of the link source comprises in-silence link information which expresses a starting point and an ending point of the silence area as the link destinations.

According to a tenth aspect of the present invention, it is a matter of course that the advantages similar to those of any one of the second to ninth aspects can be obtained. Moreover, when the link source is situated in a silence area in the reproduction data, the link information of the link source includes in-silence link information expressing a starting point and an ending point of the silence area as the link destinations.

That is, because the link based on the in-silence link information is the one moving in the silence area, for example, it becomes possible to omit the silence area at the time of high speed reproduction, or to spend time in the silence area at the time of slow speed reproduction, by using the link. Consequently, the link is effective.

Preferably, the reproduction data is the sound data; and when the link source is situated in a first silence area in the reproduction data, the link information of the link source comprises inter-silence link information which expresses an ending point of a second silence area different from the first silence area in the reproduction data as the link destination.

According to an eleventh aspect of the present invention, it is a matter of course that the advantages similar to those of any one of the second to tenth aspects can be obtained. Moreover, when the link source is situated in a silence area in the reproduction data, the link information of the link source includes inter-silence link information expressing an ending point of a silence area different from the former silence area in the reproduction data as the link destination.

That is, because the link based on the inter-silence link information is the one for moving between different silence areas, for example, it becomes possible to omit one word at the time of high speed reproduction by using the link. Consequently, the link is effective.

Preferably, the reproduction data is the sound data, and when the link source is situated at a starting point or an ending point in a periodic sound area in the reproduction data, the link information of the link source comprises periodic sound link information which expresses the starting point and the ending point of the periodic sound area, respectively, as the link destinations.

According to a twelfth aspect of the present invention, it is a matter of course that the advantages similar to those of any one of the second to eleventh aspects can be obtained. Moreover, when the link source is situated at a starting point or an ending point in a periodic sound area in the reproduction data, the link information of the link source includes periodic sound link information expressing the starting point and the ending point of the periodic sound area, respectively, as the link destinations.

That is, because the link based on the periodic sound link information is the one in the periodic sound area, for example, it becomes possible to omit the periodic sound area at the time of high speed reproduction, or to spend time in the periodic sound area at the time of slow speed reproduction by using the link. Consequently, the link is effective.

Preferably, the link information of the link source comprises subjective link information which expresses a specified link destination specified by a user as the link destination.

According to a thirteenth aspect of the present invention, it is a matter of course that the advantages similar to those of any one of the second to twelfth aspects can be obtained. Moreover, the link information of the link source includes subjective link information expressing a specified link destination specified by a user as the link destination.

That is, because the link based on the subjective link information is the one provided based on user's subjective judgment, for example, it becomes possible to reproduce the area that the user has judged to be important without omitting the area, or to omit the area that the user has judged to be unnecessary, by using the link. Consequently, the link is effective.

The user is a person to produce the link information here, and the user may be, for example, a person who has produced reproduction data D (for example, when the reproduction data D is a movie, the user is a director. When the reproduction data D is a documentary program, the user is an editor), or may be a person who appreciates the reproduction data D (a viewer of the reproduction data D).

Preferably, the reproducing apparatus further comprises a link information producing section to produce the link information.

According to a fourteenth aspect of the present invention, it is a matter of course that the advantages similar to those of any one of the first to thirteenth aspects can be obtained. Moreover, the aspect includes a link information producing section producing the link information.

Consequently, it is possible to produce the link information to reproduce the reproduction data based on the produced link information.

The entire disclosure of Japanese Patent Application No. 2007-068900 filed on Mar. 16, 2007 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A reproducing apparatus comprising:

a reproduction section to reproduce reproduction data comprising sound data and/or image data;

a selection section to calculate evaluation values between a link source and each of a plurality of link destinations by a predetermined arithmetic expression based on link information which pertains to the plurality of link destinations corresponding to the link source, and which is set to the reproduction data in advance, and to select a link destination having a highest evaluation among the evaluation values out of the plurality of link destinations, wherein the selection section performs the calculation and selection at least one time;

a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data;

a specification section to specify a reproduction speed of the reproduction data; and a storage section to store the number of times that each of the link destinations is selected by the selection section, wherein for each link destination, the link information comprises:

link destination position information pertaining to a position of the link destination in the reproduction data;

discrepancy degree information pertaining to a discrepancy degree between a waveform of the link source and a waveform of the link destination; and loss information pertaining to a loss of signal energy caused by moving the reproduction point from the link source to the link destination, and wherein the selection section obtains error information pertaining to a temporal error between a specified reproduction point according to the reproduction speed specified by the specification section in the reproduction data and a link destination point based on the link destination position information included in the link information, calculates the evaluation values, each evaluation value being a sum of a product of the obtained error information and a weight for the error information set in the error information, a product of the discrepancy degree information included in the link information and a weight for the discrepancy degree information set in the discrepancy degree information, and a product of the loss information included in the link information and a weight for the loss information set in the loss information, and selects the link destination having a smallest evaluation value out of the link destinations for which the number of times that the link destination is selected is less than a predetermined threshold value, among the plurality of link destinations.

2. The reproducing apparatus according to claim 1, further comprising a link information producing section to produce the link information.

3. A reproducing apparatus comprising:

a reproduction section to reproduce reproduction data comprising sound data and/or image data;

a selection section to calculate evaluation values between a link source and each of a plurality of link destinations by a predetermined arithmetic expression based on link information which pertains to the plurality of link destinations corresponding to the link source, and which is set to the reproduction data in advance, and to select a link destination having a highest evaluation among the evaluation values out of the plurality of link destinations; and a reproduction control section to move a reproduction point of the reproduction data reproduced by the reproduction section to a position corresponding to the link destination selected by the selection section by linking the link source with the link destination when the reproduction point reaches a given point with respect to a position corresponding to the link source, and to instruct the reproduction section to reproduce the reproduction data, wherein, for each link destination, the link information comprises:

link destination position information pertaining to a position of the link destination in the reproduction data;

discrepancy degree information pertaining to a discrepancy degree between a waveform of the link source and a waveform of the link destination; and loss information pertaining to a loss of signal energy caused by moving the reproduction point from the link source to the link destination.

4. The reproducing apparatus according to claim 3, further comprising a specification section to specify a reproduction speed of the reproduction data, wherein the selection section obtains error information pertaining to a temporal error between a specified reproduction point according to the reproduction speed specified by the specification section in the reproduction data and a link destination point based on the link destination position information included in the link information, and calculates the evaluation values based on the obtained error information and at least one of the discrepancy degree information and the loss information, both of which are included in the link information.

5. The reproducing apparatus according to claim 4, wherein each of the evaluation values is a sum of a product of the error information and a weight for the error information settable in the error information, and at least one of a product of the discrepancy degree information and a weight for the discrepancy degree information settable in the discrepancy degree information and a product of the loss information and a weight for the loss information settable in the loss information, and wherein the link destination having the highest evaluation among the evaluation values is the link destination having a smallest evaluation value.

6. The reproducing apparatus according to claim 5, wherein different weights for the error information are settable to the error information obtained from the link information pertaining to the link destinations existing in a temporally future direction compared to the link source, and to the error information obtained from the link information pertaining to the link destinations existing in a temporally past direction compared to the link source, wherein different weights for the discrepancy degree information are settable to the discrepancy degree information included in the link information pertaining to the link destinations existing in the temporally future direction compared to the link source, and to the discrepancy degree information included in the link information pertaining to the link destinations existing in the temporally past direction compared to the link source, and wherein different weights for the loss information are settable to the loss information included in the link information pertaining to the link destinations existing in the temporally future direction compared to the link source, and to the loss information included in the link information pertaining to the link destinations existing in the temporally past direction compared to the link source.

7. The reproducing apparatus according to claim 3, wherein the selection section performs the calculation and selection at least one time, and the reproducing apparatus further comprises a storage section to store the number of times that each of the link destinations is selected by the selection section, wherein the selection section selects the link destination having the highest evaluation in the evaluation values out of the link destinations for which the number of times that the link destination is selected is less than a predetermined threshold value, among the plurality of link destinations.

8. The reproducing apparatus according to claim 3, wherein the reproduction data is recorded on a given recording medium together with the link information set to the reproduction data in advance.

9. The reproducing apparatus according to claim 3, further comprising a display control section to instruct a display apparatus to display a link image based on link display data produced based on the link information in order to display a temporal association between the link source and each of the link destinations.

10. The reproducing apparatus according to claim 3, wherein for at least one link destination, the link information comprises simple link information which expresses a minimum discrepancy degree point as the link destination, the minimum discrepancy degree point having a smallest discrepancy degree based on the discrepancy degree information among arbitrary points existing within a given retrieval range from a position of the link source.

11. The reproducing apparatus according to claim 3, wherein the reproduction data is the sound data, and for at least two link destinations, when the link source is situated in a silence area in the reproduction data, the link information comprises in-silence link information which expresses a starting point and an ending point of the silence area as the link destinations.

12. The reproducing apparatus according to claim 3, wherein:

the reproduction data is the sound data; and for at least one link destination, when the link source is situated in a first silence area in the reproduction data, the link information comprises inter-silence link information which expresses an ending point of a second silence area different from the first silence area in the reproduction data as the link destination.

13. The reproducing apparatus according to claim 3, wherein the reproduction data is the sound data, and for at least two link destinations, when the link source is situated at a starting point or an ending point in a periodic sound area in the reproduction data, the link information comprises periodic sound link information which expresses the starting point and the ending point of the periodic sound area as the link destinations.

14. The reproducing apparatus according to claim 3, wherein for at least one link destination, the link information comprises subjective link information which expresses a specified link destination specified by a user as the link destination.

15. The reproducing apparatus according to claim 3, further comprising a link information producing section to produce the link information.

* * * * *